US010205241B2

(12) United States Patent
Ng et al.

(10) Patent No.: US 10,205,241 B2
(45) Date of Patent: Feb. 12, 2019

(54) LOW PROFILE OMNIDIRECTIONAL ANTENNAS

(71) Applicant: Laird Technologies, Inc., Earth City, MO (US)

(72) Inventors: Kok Jiunn Ng, Perak (MY); Choon Chung Su, Perak (MY); Chit Yong Hang, Penang (MY)

(73) Assignee: Laird Technology, Inc., Chesterfield, MO (US)

( * ) Notice: Subject to any disclaimer, the term of this patent is extended or adjusted under 35 U.S.C. 154(b) by 112 days.

(21) Appl. No.: 15/241,890

(22) Filed: Aug. 19, 2016

(65) Prior Publication Data

US 2017/0324167 A1 Nov. 9, 2017

(30) Foreign Application Priority Data

May 5, 2016 (MY) ..... PI2016701614

(51) Int. Cl.
*H01Q 1/48* (2006.01)
*H01Q 1/24* (2006.01)
(Continued)

(52) U.S. Cl.
CPC ..... *H01Q 9/065* (2013.01); *H01Q 1/241* (2013.01); *H01Q 1/38* (2013.01); *H01Q 1/42* (2013.01); *H01Q 1/48* (2013.01)

(58) Field of Classification Search
CPC ..... H01Q 1/48; H01Q 9/065
See application file for complete search history.

(56) References Cited

U.S. PATENT DOCUMENTS 4,291,311 A * 9/1981 Kaloi ..... H01Q 1/48 343/700 MS
6,018,324 A * 1/2000 Kitchener ..... H01Q 1/38 343/702

(Continued)

FOREIGN PATENT DOCUMENTS

| | | |
|---|---|---|
| CN | 101375464 A | 2/2009 |
| TW | M538255 U | 3/2017 |
| WO | WO-2016018547 A1 | 2/2016 |

OTHER PUBLICATIONS

International Search Report and Written Opinion dated Aug. 17, 2017 for PCT Application No. PCT/US2017/031229 filed May 5, 2017 which claims priority to the instant application, 12 pages.

(Continued)

*Primary Examiner* — Hoang Nguyen
*Assistant Examiner* — Awat Salih
(74) *Attorney, Agent, or Firm* — Harness, Dickey & Pierce, PLC; Anthony G. Fussner

(57) ABSTRACT

Disclosed are exemplary embodiments of a low profile wideband and/or multiband omnidirectional antennas. In an exemplary embodiment, an antenna generally includes a radiator and a ground plane. The ground plane may include a slanted surface along or defining an edge portion of the ground plane. The slanted surface may be configured to be operable for reducing null at azimuth plane to thereby allow the antenna to have more omnidirectional radiation patterns for the azimuth plane. In another exemplary embodiment, an antenna generally includes a substrate, a radiator along the substrate, and electrically-conductive tape or foil defining at least part of a ground plane. The electrically-conductive tape or foil is coupled to a ground of the radiator via proximity coupling and electrically insulated by masking of the substrate.

19 Claims, 49 Drawing Sheets

(51) Int. Cl.

| | |
|---|---|
| ***H01Q 9/06*** | (2006.01) |
| ***H01Q 1/38*** | (2006.01) |
| ***H01Q 1/42*** | (2006.01) |

(56) References Cited

U.S. PATENT DOCUMENTS

| | | | | |
|---|---|---|---|---|
| 6,603,429 | B1 | 8/2003 | Bancroft et al. | |
| 6,661,380 | B1 | 12/2003 | Bancroft et al. | |
| 6,956,529 | B1* | 10/2005 | Chen | H01Q 1/38 343/700 MS |
| 2003/0103008 | A1 | 6/2003 | Petropoulos et al. | |
| 2003/0164798 | A1 | 9/2003 | Nevermann | |
| 2004/0212541 | A1* | 10/2004 | Apostolos | H01Q 1/36 343/742 |
| 2007/0103369 | A1 | 5/2007 | Ratni et al. | |
| 2009/0015483 | A1* | 1/2009 | Liu | H01Q 9/0457 343/700 MS |
| 2009/0322619 | A1* | 12/2009 | Ollikainen | H01Q 1/243 343/702 |
| 2011/0148718 | A1* | 6/2011 | Wang | H01Q 1/243 343/702 |
| 2014/0028519 | A1* | 1/2014 | Kim | H01Q 21/0075 343/844 |
| 2014/0118207 | A1* | 5/2014 | Chang | H01Q 1/243 343/767 |
| 2014/0118209 | A1 | 5/2014 | Yona | |
| 2015/0357714 | A1* | 12/2015 | Ng | H01Q 1/48 343/848 |

OTHER PUBLICATIONS

Taiwan office action for TW application No. 105129773 which claims priority to the instant application, dated Apr. 9, 2018, 10 pages.

* cited by examiner

Radiation Pattern at 698 MHz

Radiation Pattern at 746 MHz

Radiation Pattern at 894 MHz

Radiation Pattern at 850 MHz

Radiation Pattern at 1350 MHz

Radiation Pattern at 1448 MHz

Radiation Pattern at 1525 MHz

Radiation Pattern at 1850 MHz

Radiation Pattern at 1930 MHz

Radiation Pattern at 2170 MHz

Radiation Pattern at 2412 MHz

Radiation Pattern at 2506.5 MHz

Radiation Pattern at 2600 MHz

Radiation Pattern at 2700 MHz

Radiation Pattern at 3300 MHz

Radiation Pattern at 3800 MHz

Radiation Pattern at 698 MHz

Radiation Pattern at 824 MHz

Radiation Pattern at 850 MHz

Radiation Pattern at 960 MHz

Radiation Pattern at 1350 MHz

Radiation Pattern at 1500 MHz

Radiation Pattern at 1525 MHz

Radiation Pattern at 1680 MHz

Radiation Pattern at 2170 MHz

Radiation Pattern at 2310 MHz

Radiation Pattern at 2510 MHz

Radiation Pattern at 2700 MHz

Radiation Pattern at 3300 MHz
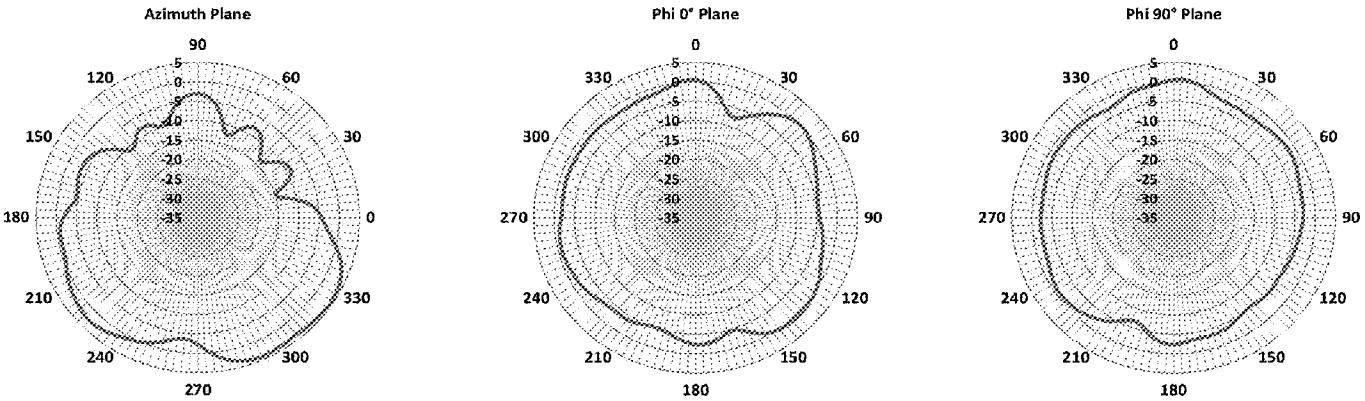
FIG. 132
FIG. 133
FIG. 134
Radiation Pattern at 3800 MHz
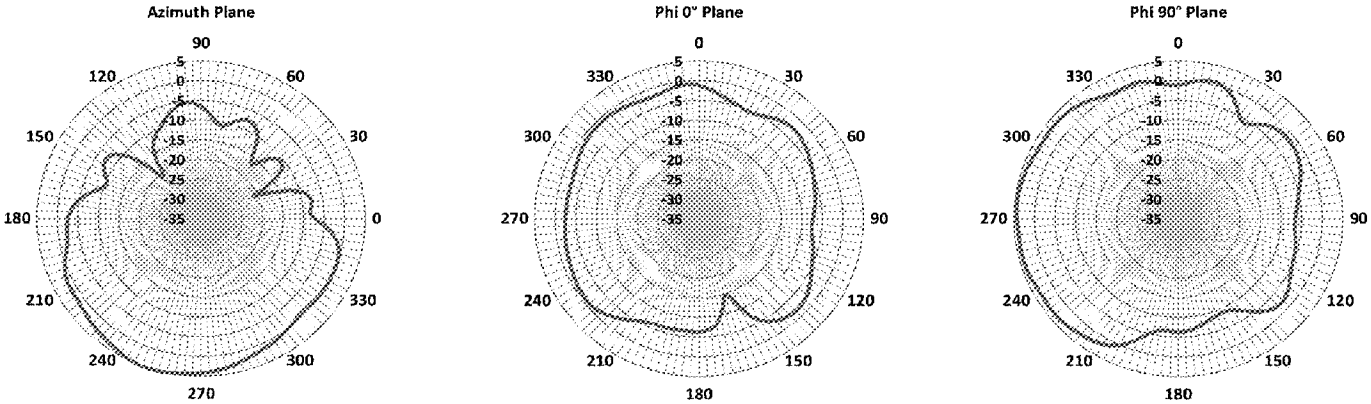
FIG. 135
FIG. 136
FIG. 137

LOW PROFILE OMNIDIRECTIONAL ANTENNAS

CROSS-REFERENCE TO RELATED APPLICATION

This application claims the benefit of and priority to Malaysian Patent Application No. PI2016701614 filed May 5, 2016. The entire disclosure of the above application is incorporated herein by reference.

FIELD

The present disclosure relates to low profile omnidirectional antennas.

BACKGROUND

This section provides background information related to the present disclosure which is not necessarily prior art.

For in-building cellular network applications, certain applications require a single-input single-output (SISO) antenna that is ultra-low profile and that is aesthetic looking for the building ceiling. Conventionally, this antenna type has been designed with a dipole parallel to the ceiling, which has a large null and has poor omnidirectionality in azimuth plane.

DRAWINGS

The drawings described herein are for illustrative purposes only of selected embodiments and not all possible implementations, and are not intended to limit the scope of the present disclosure.

Figure 1:
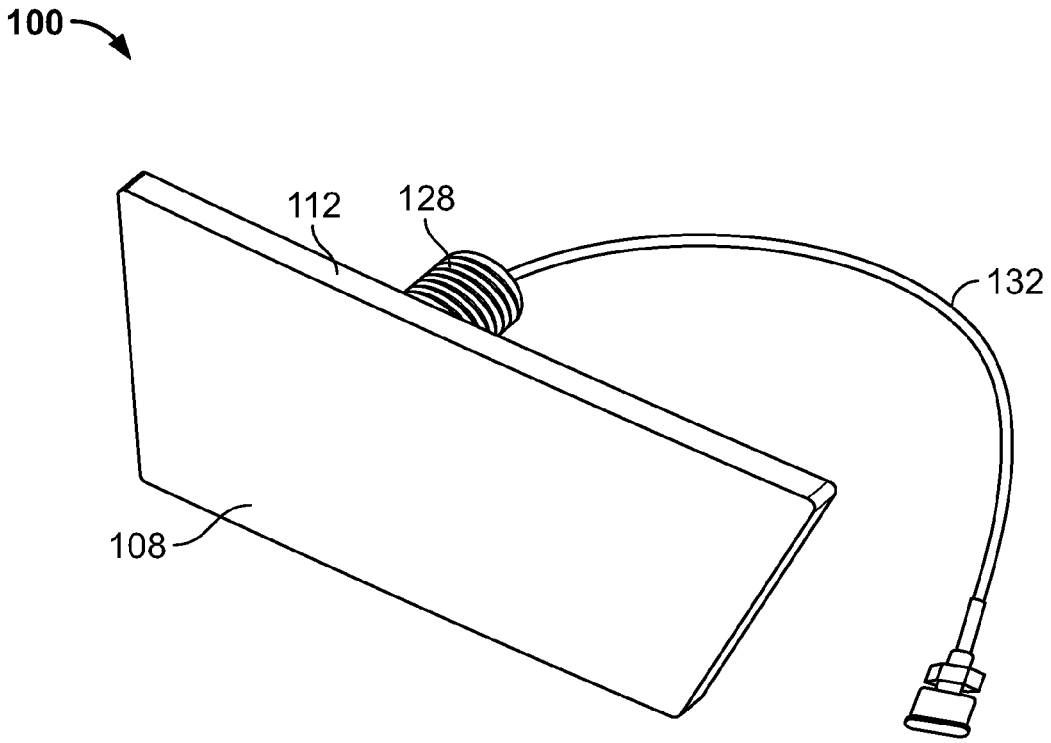
FIG. 1 is a perspective view of a low profile wideband/multiband omnidirectional SISO antenna according to an exemplary embodiment.
Figure 2A:
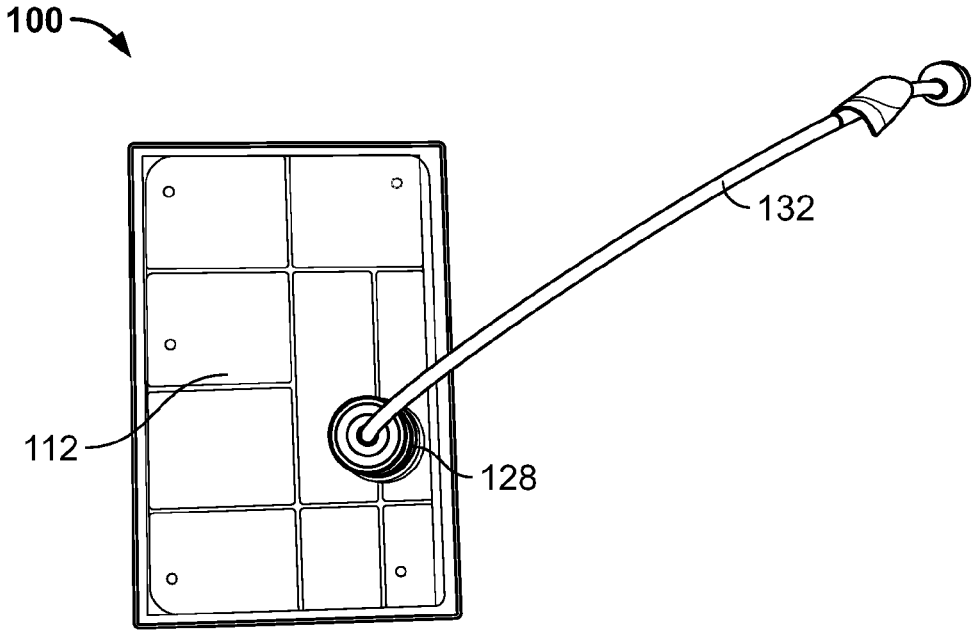
FIGS. 2A and 2B are respective back and front views of a prototype of the antenna shown in FIG. 1, where the antenna includes a transparent radome (FIG. 2B) and a transparent baseplate or support member (FIG. 2A)
Figure 2B:
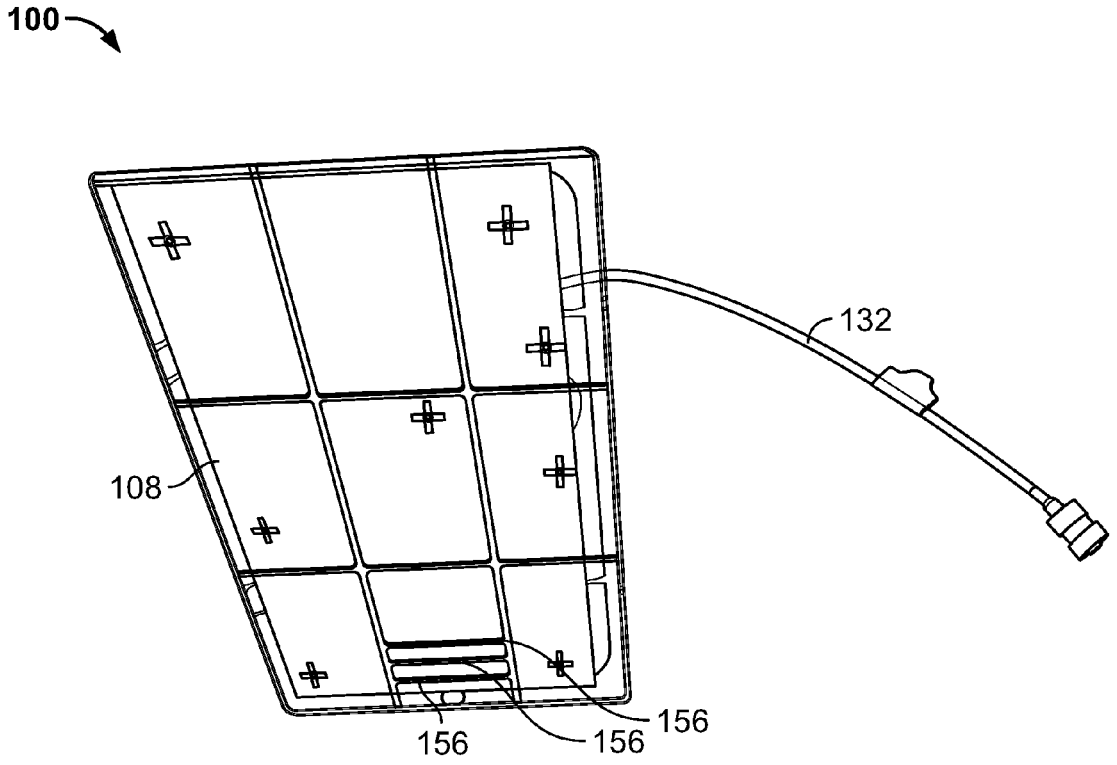
Figure 3:
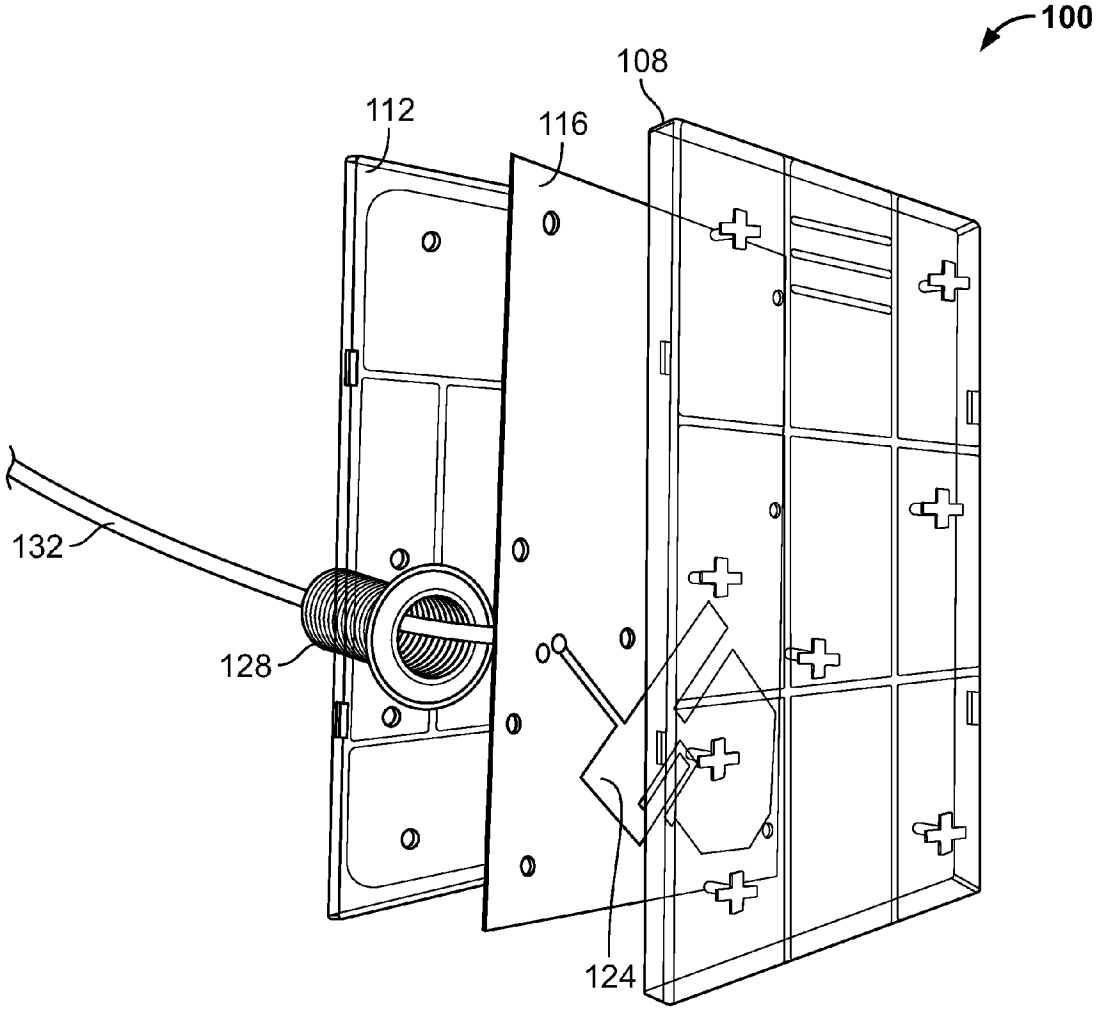
FIG. 3 is an exploded perspective view of the antenna shown in FIGS. 2A and 2B, and illustrating the printed circuit board positioned between the radome and the baseplate.
Figure 9:
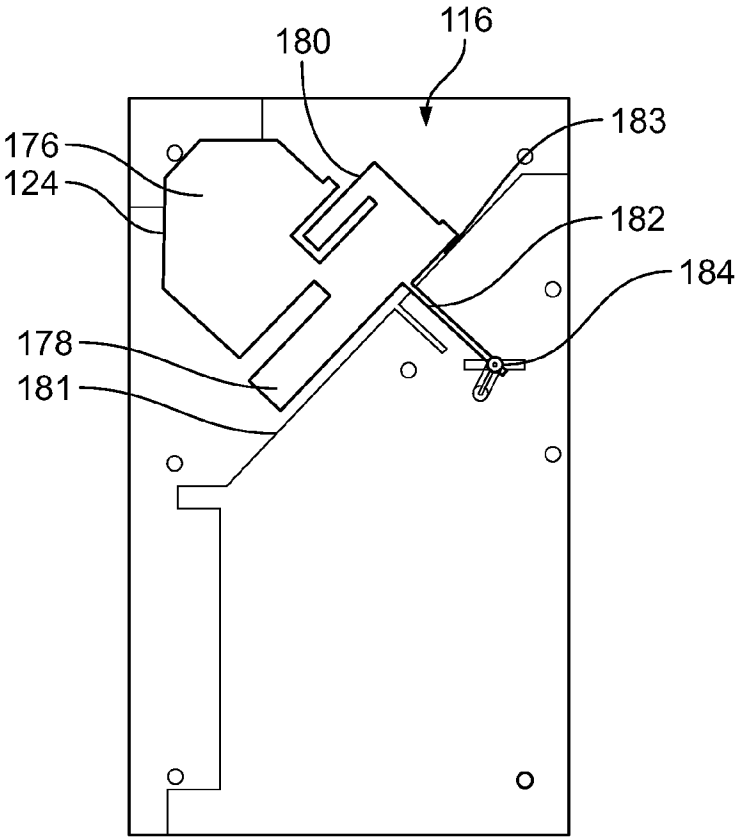
FIG. 9 is another front view of the PCB shown in FIG. 5, and illustrating the radiator along the front side of the PCB.
Figure 8:
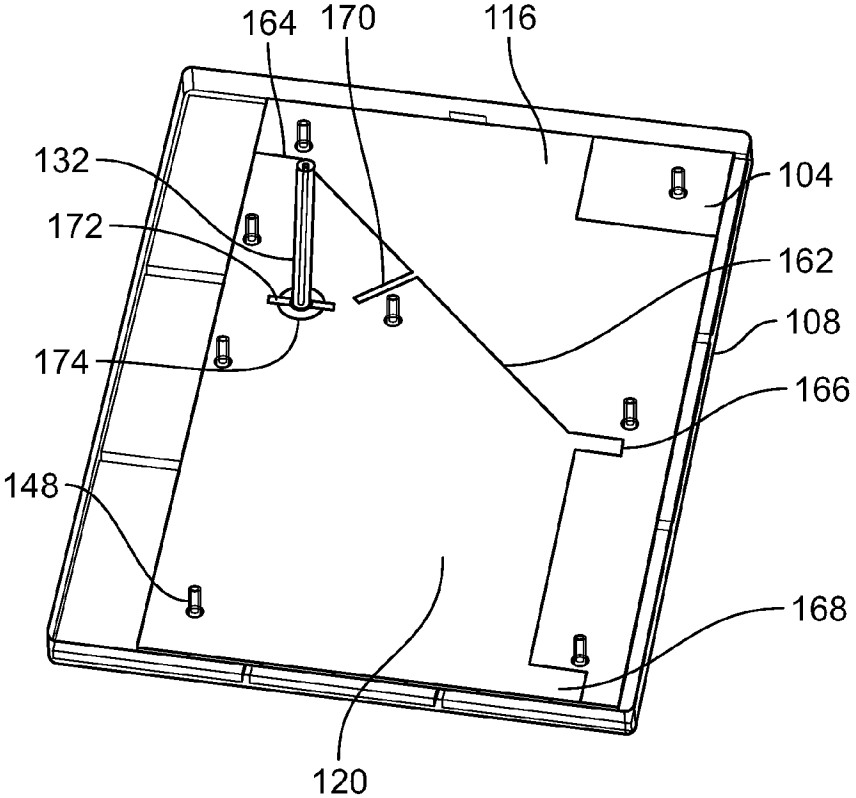
FIG. 8 is a perspective view of the PCB shown in FIG. 4, and illustrating the ground plane and the patch along the back side of the PCB.
Figure 10:
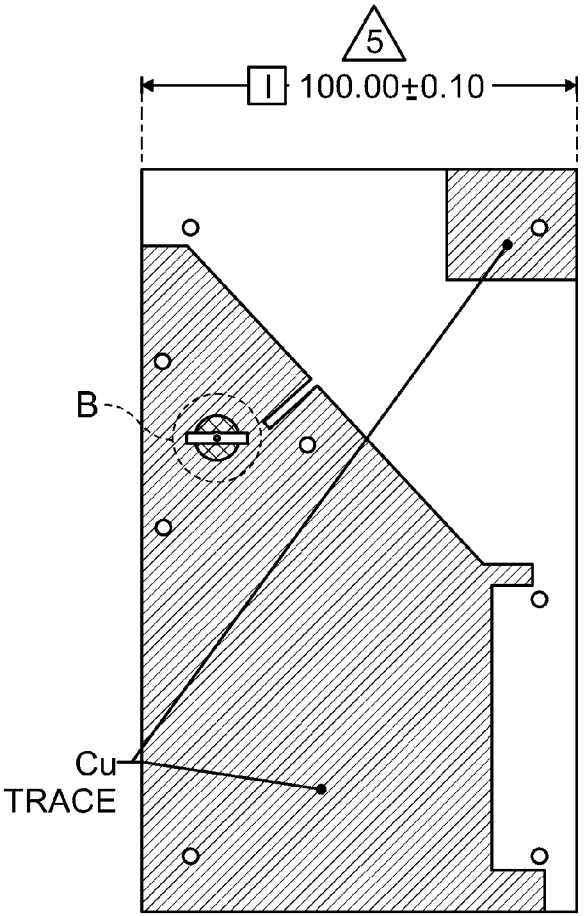
Figure 11:
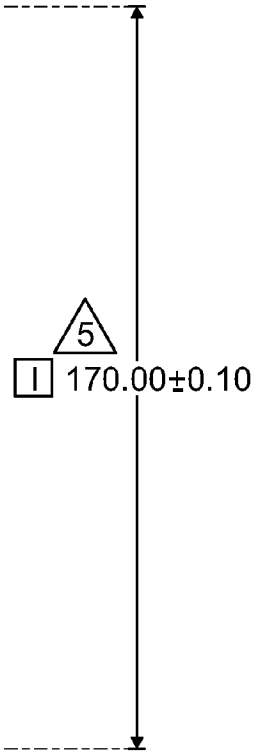
Figure 12:
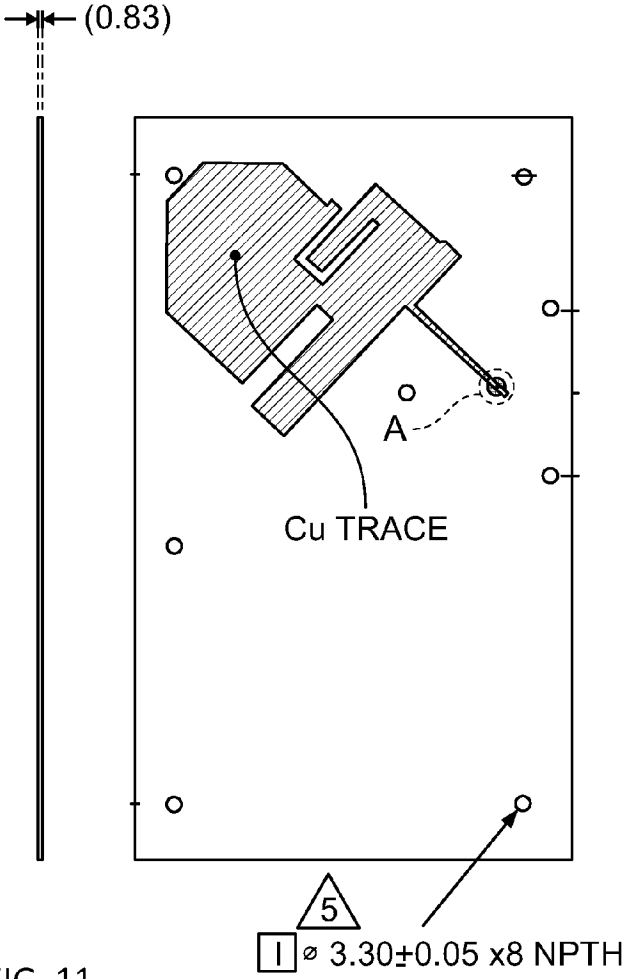
Figure 13:
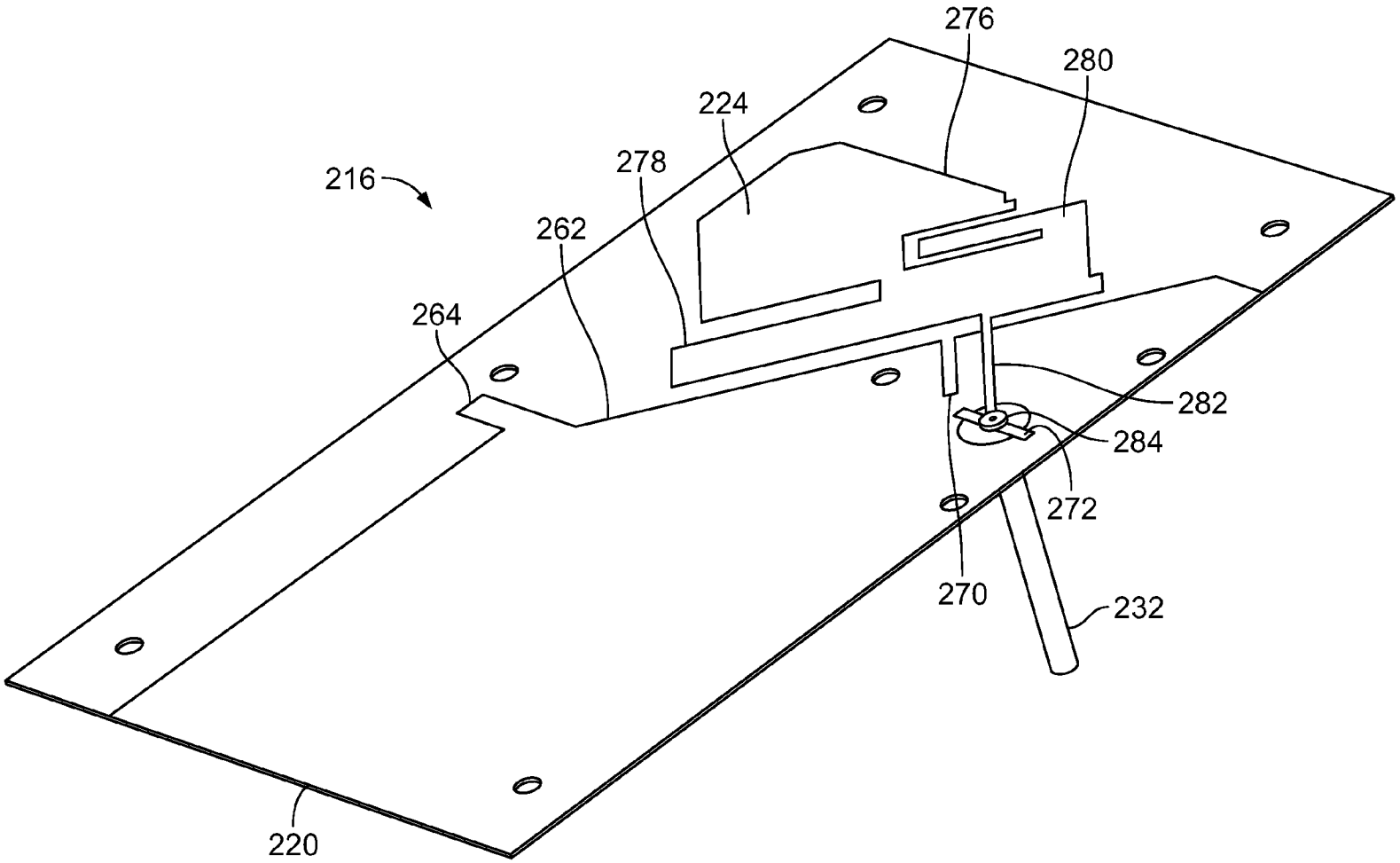
Figure 14B:
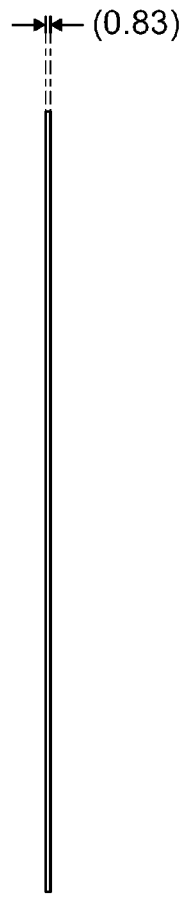
Figure 14A:
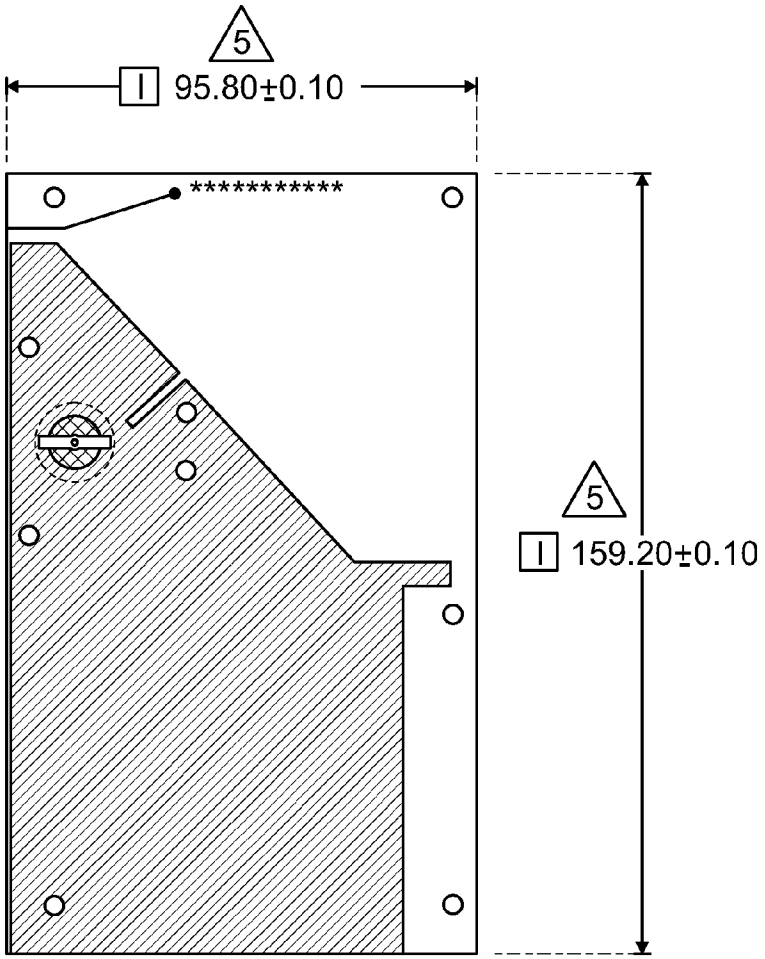
Figure 15A:
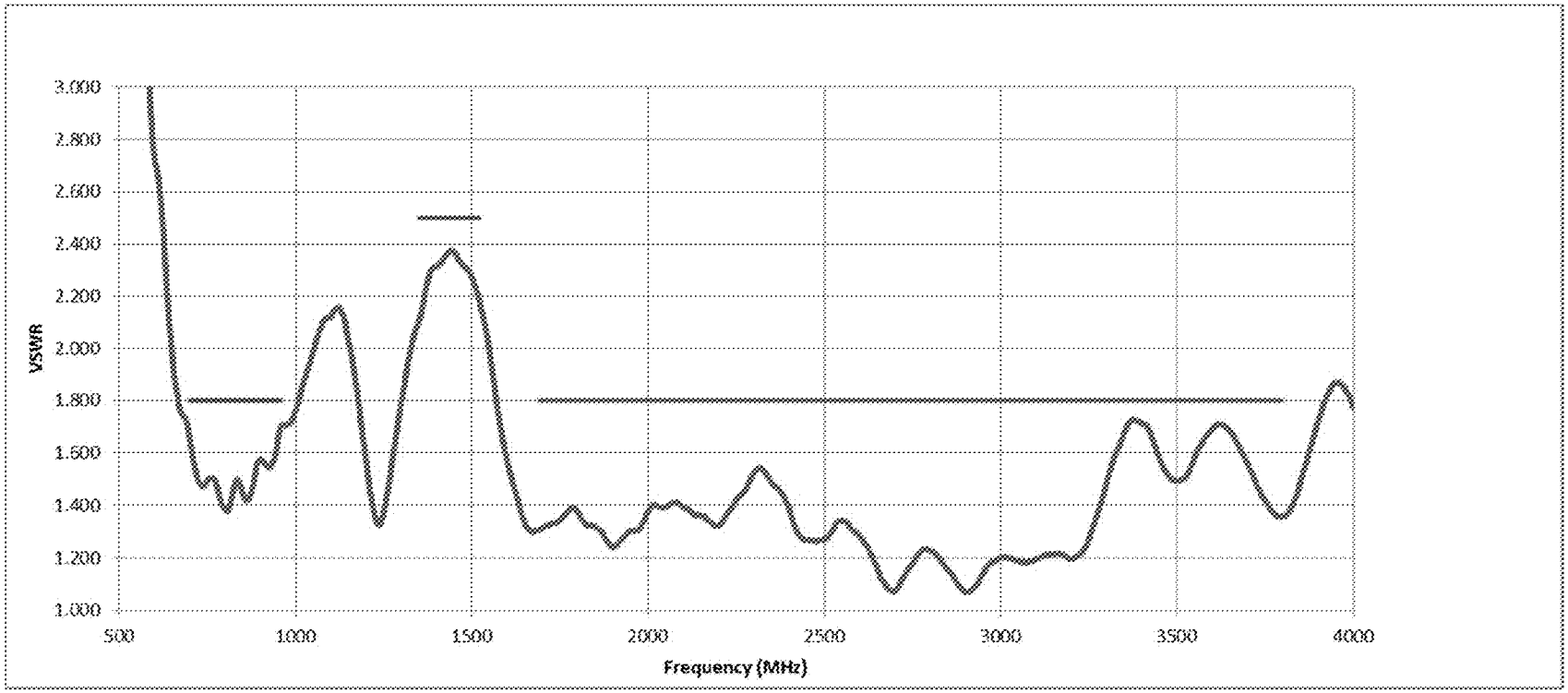
Figure 15B:
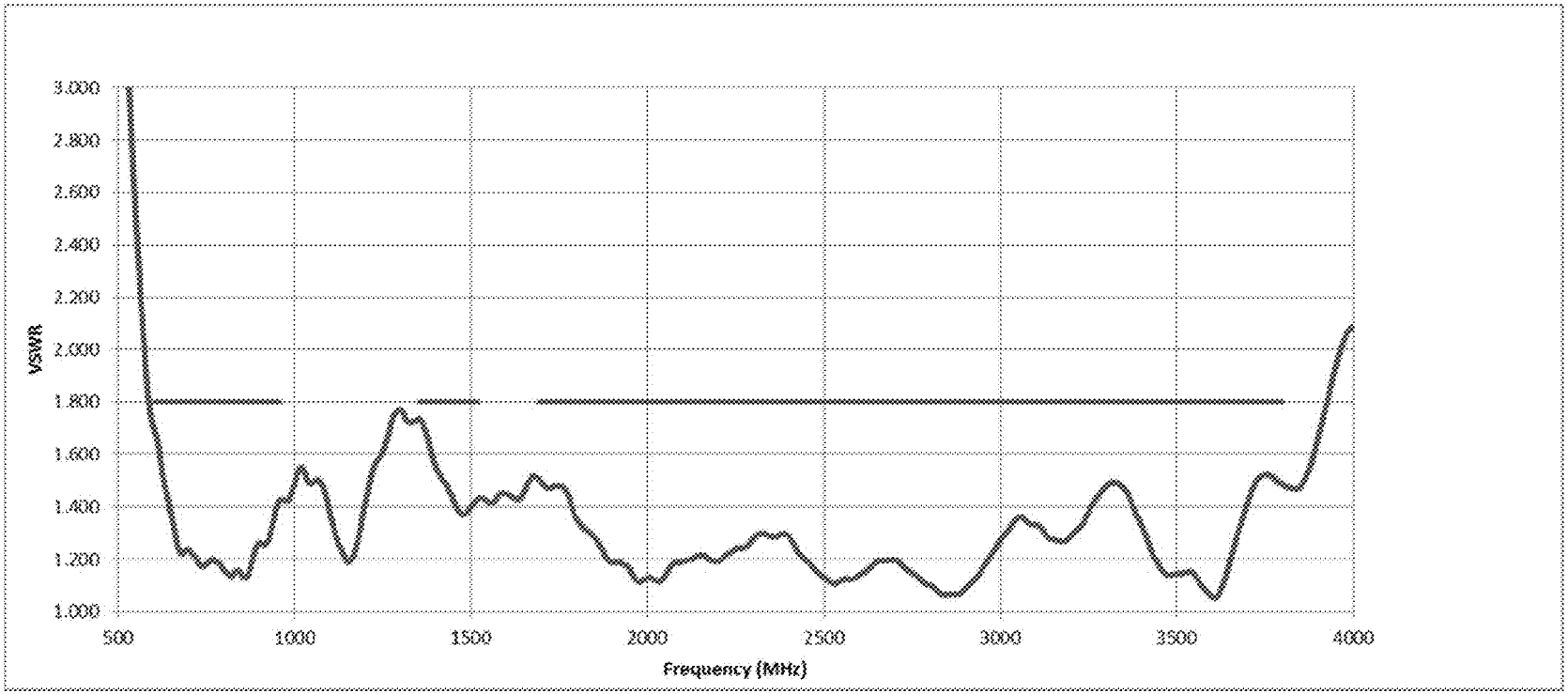
Figure 18:
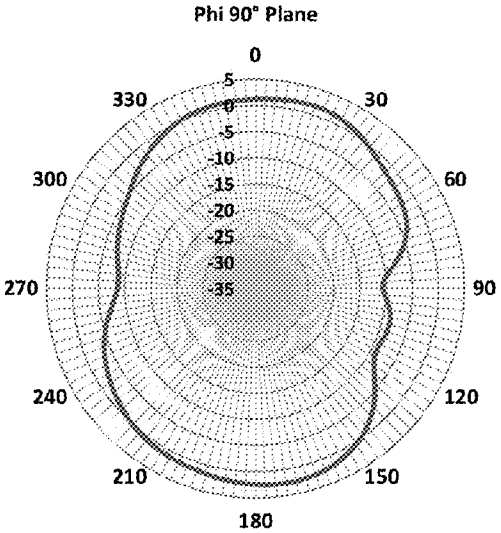
Figure 17:
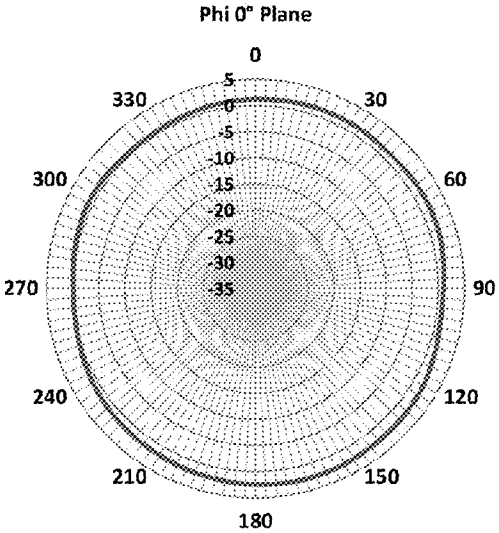
Figure 16:
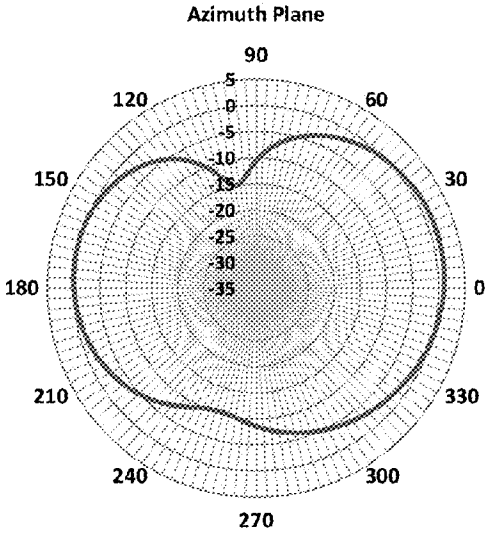
Figure 21:
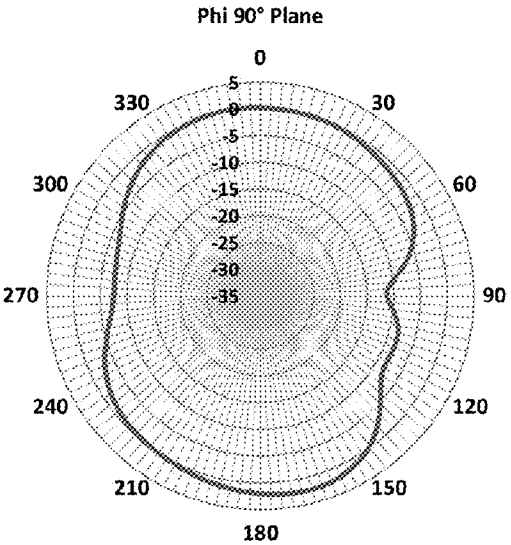
Figure 20:
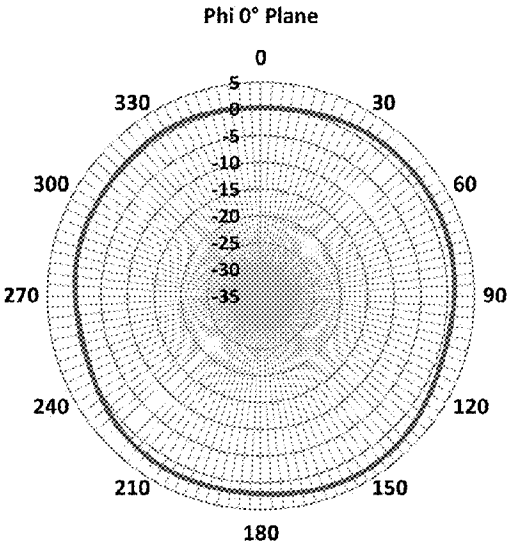
Figure 19:
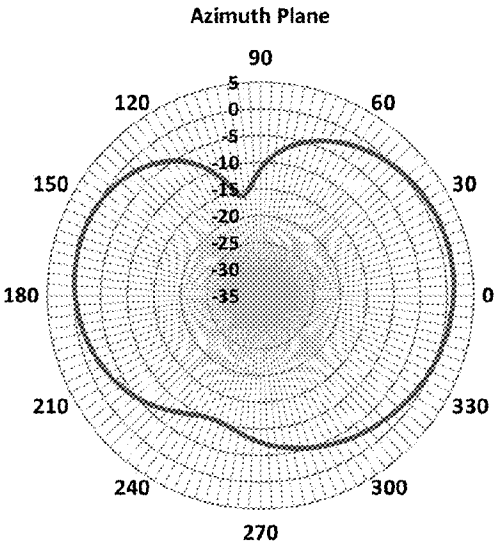
Figures 22, 23, 24:
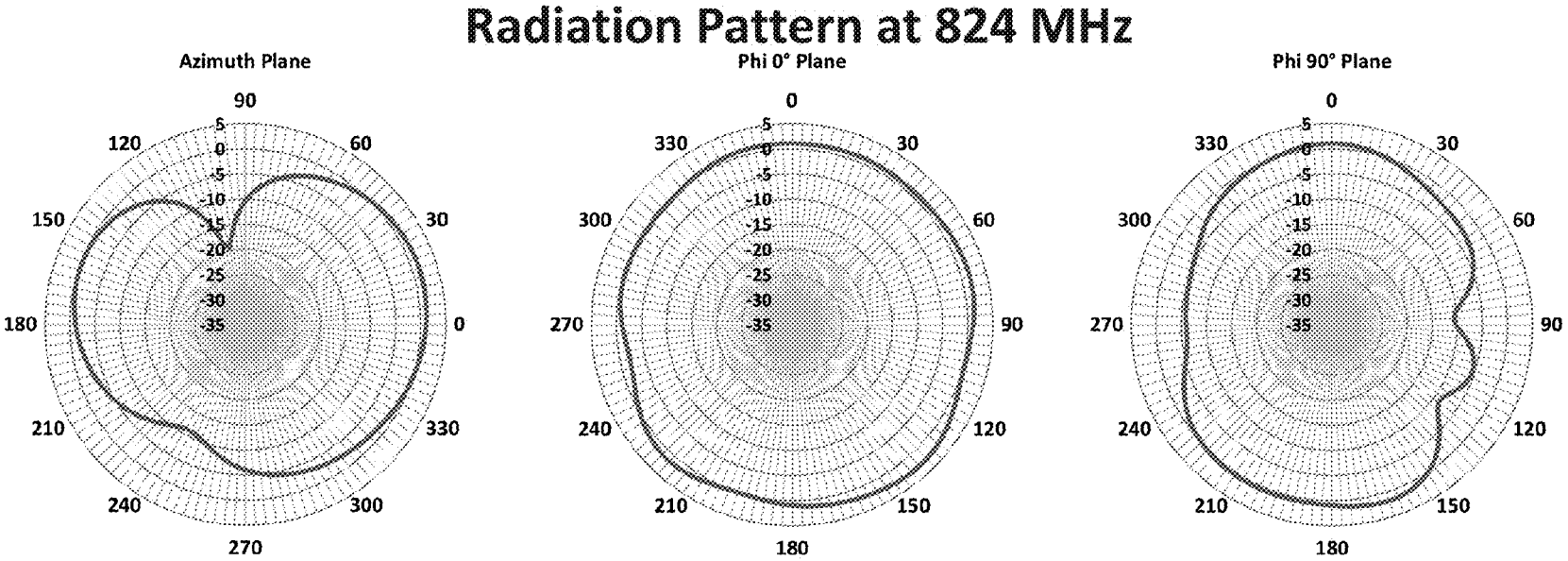
Figure 25:
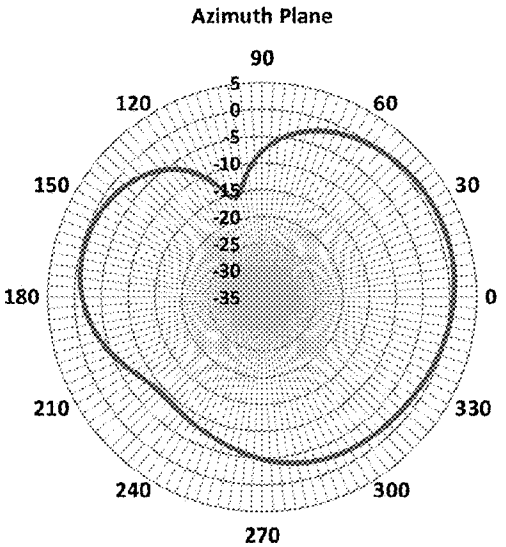
Figure 26:
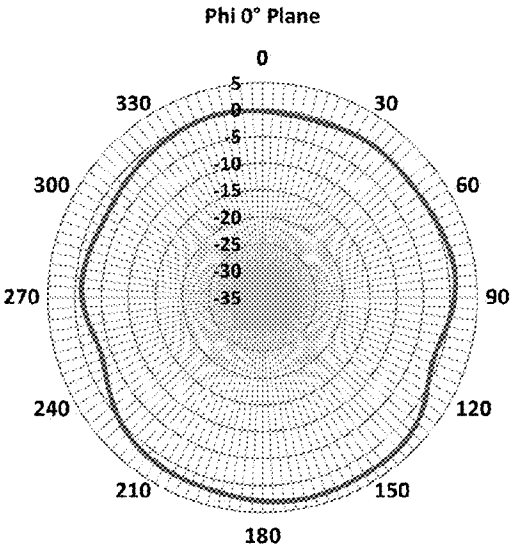
Figure 27:
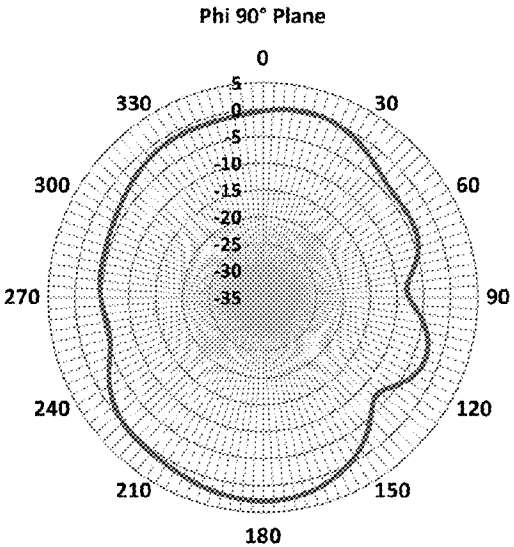
Figure 30:
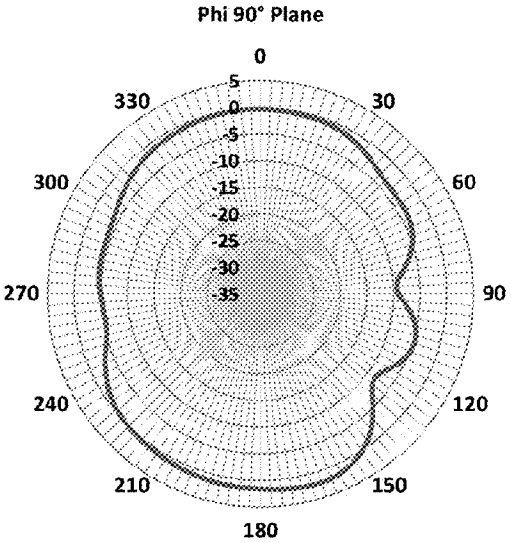
Figure 29:
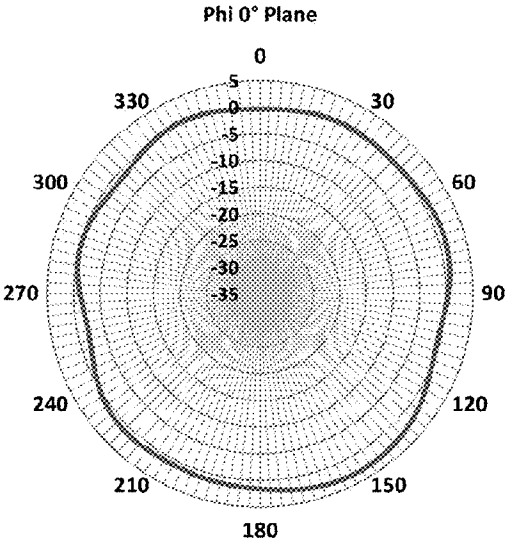
Figure 28:
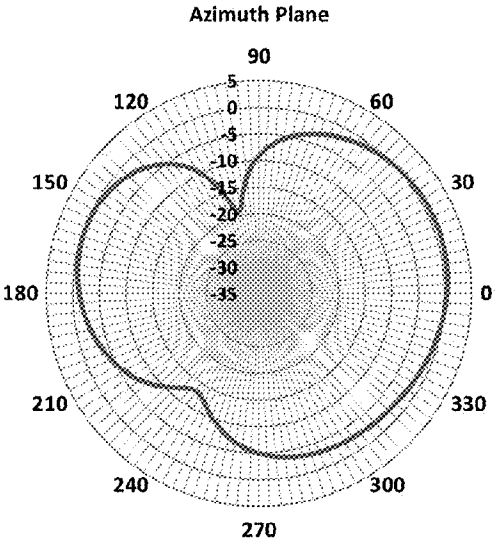
Figures 31, 32, 33:
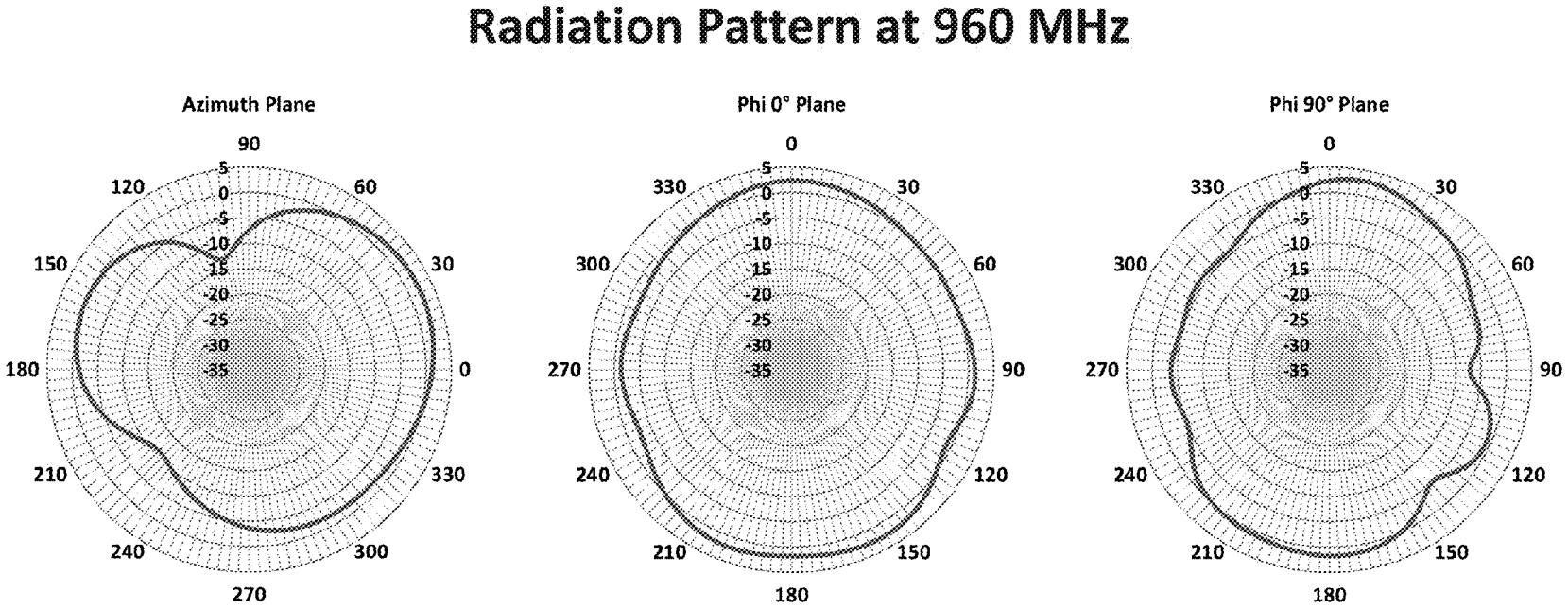
Figure 34:
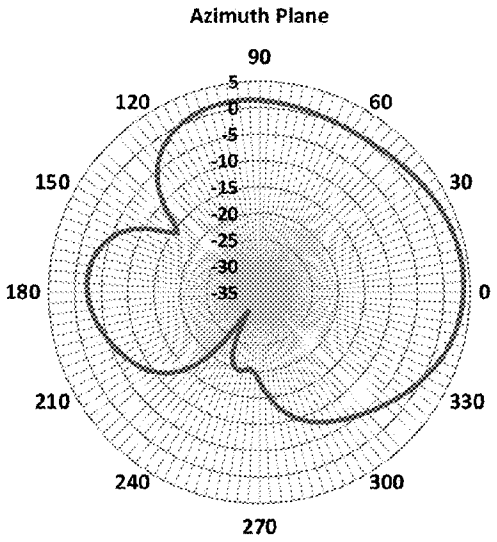
Figure 35:
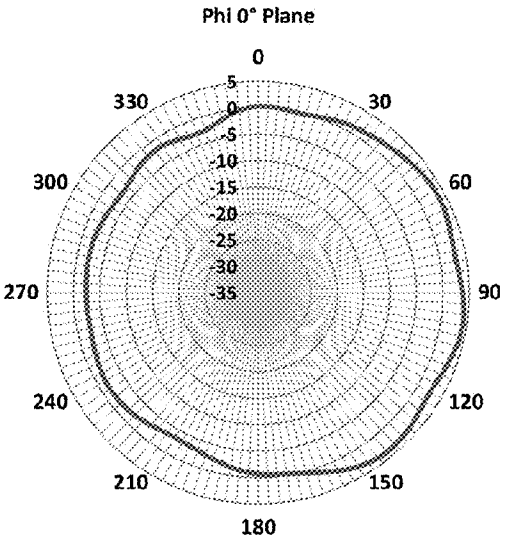
Figure 36:
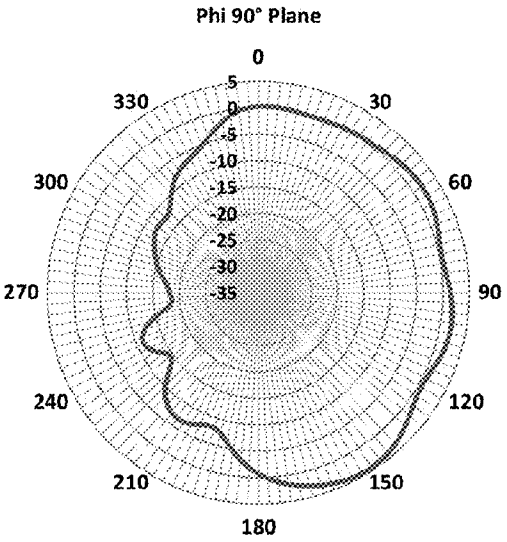
Figure 37:
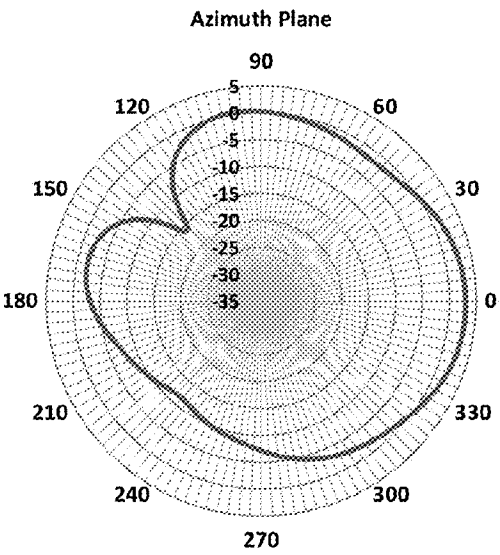
Figure 38:
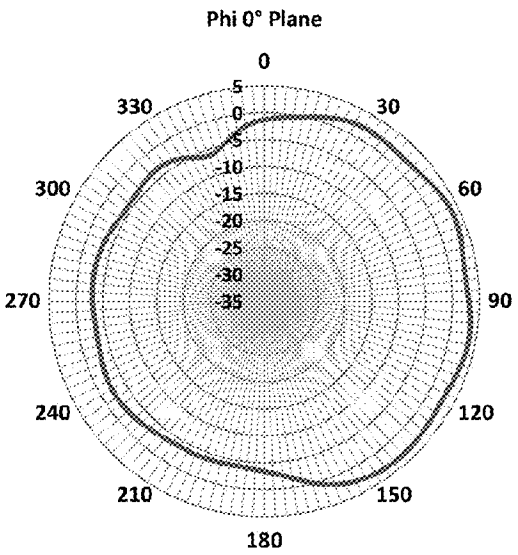
Figure 39:
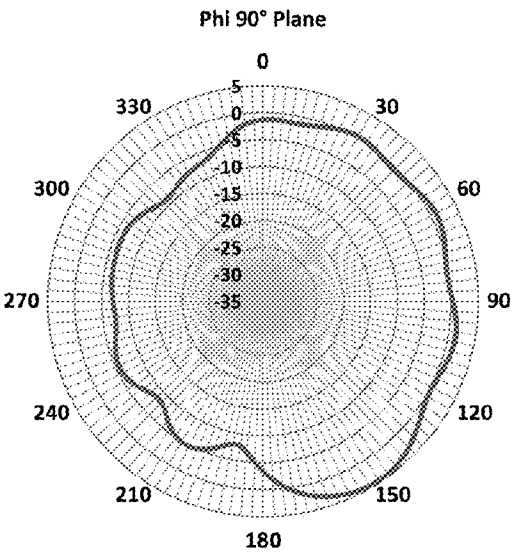
Figures 40, 41, 42:
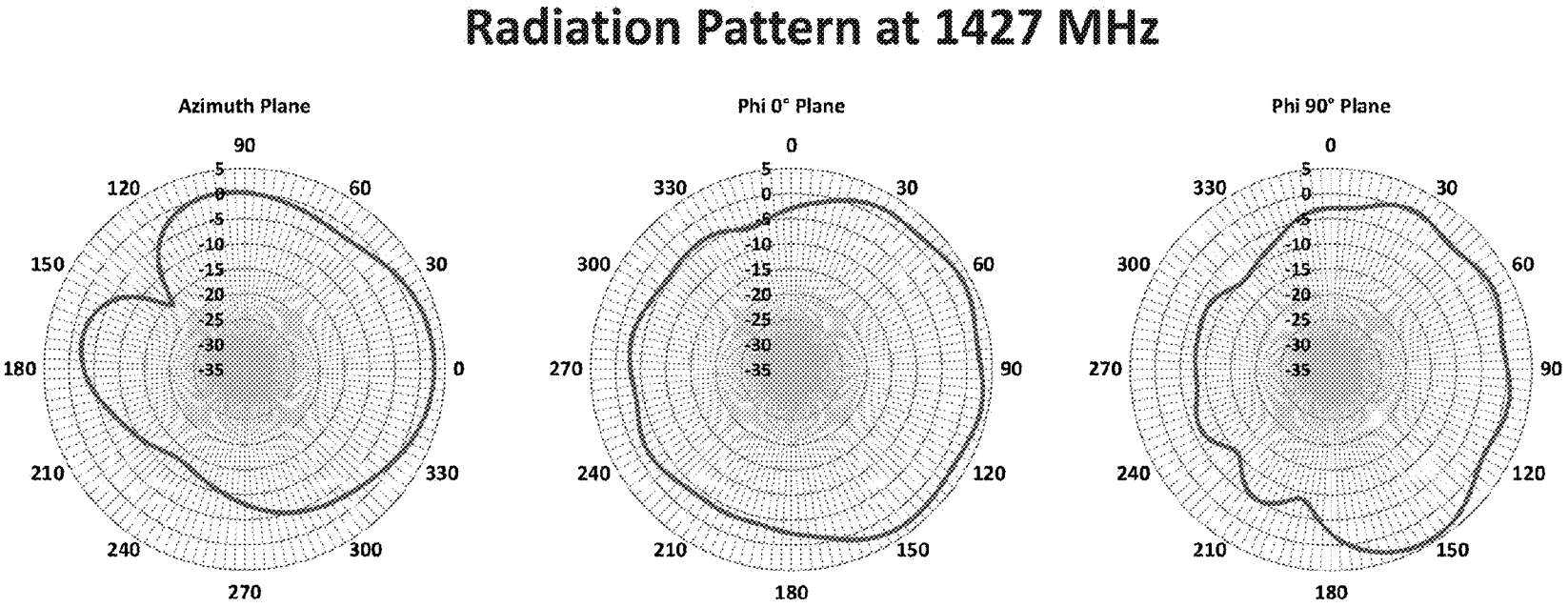
Figure 45:
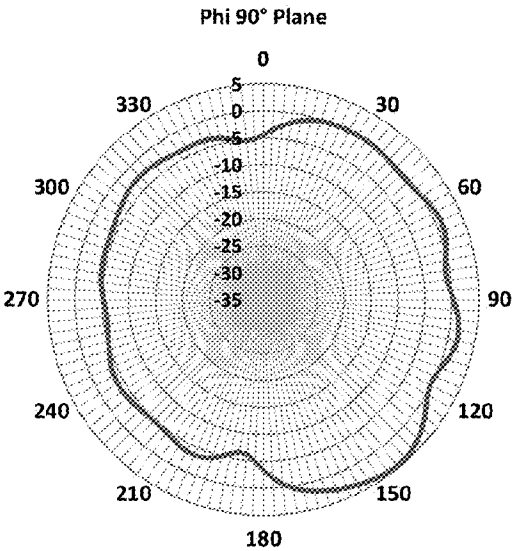
Figure 44:
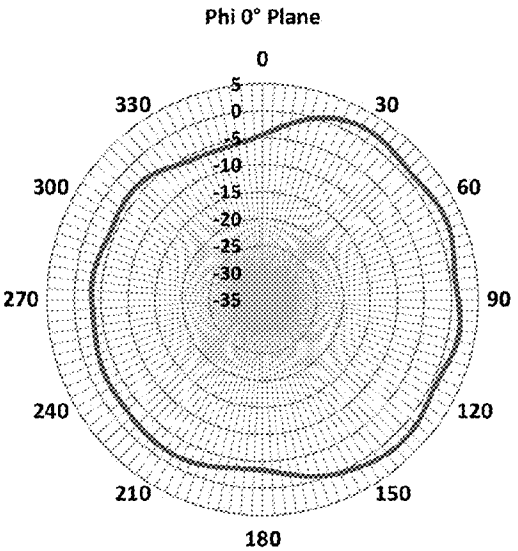
Figure 43:
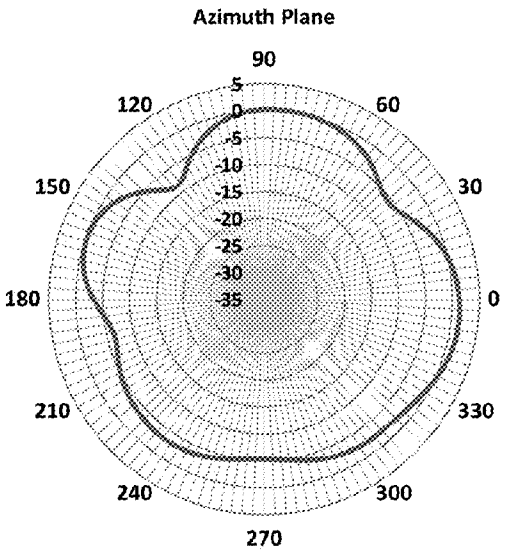
Figures 46, 47, 48:
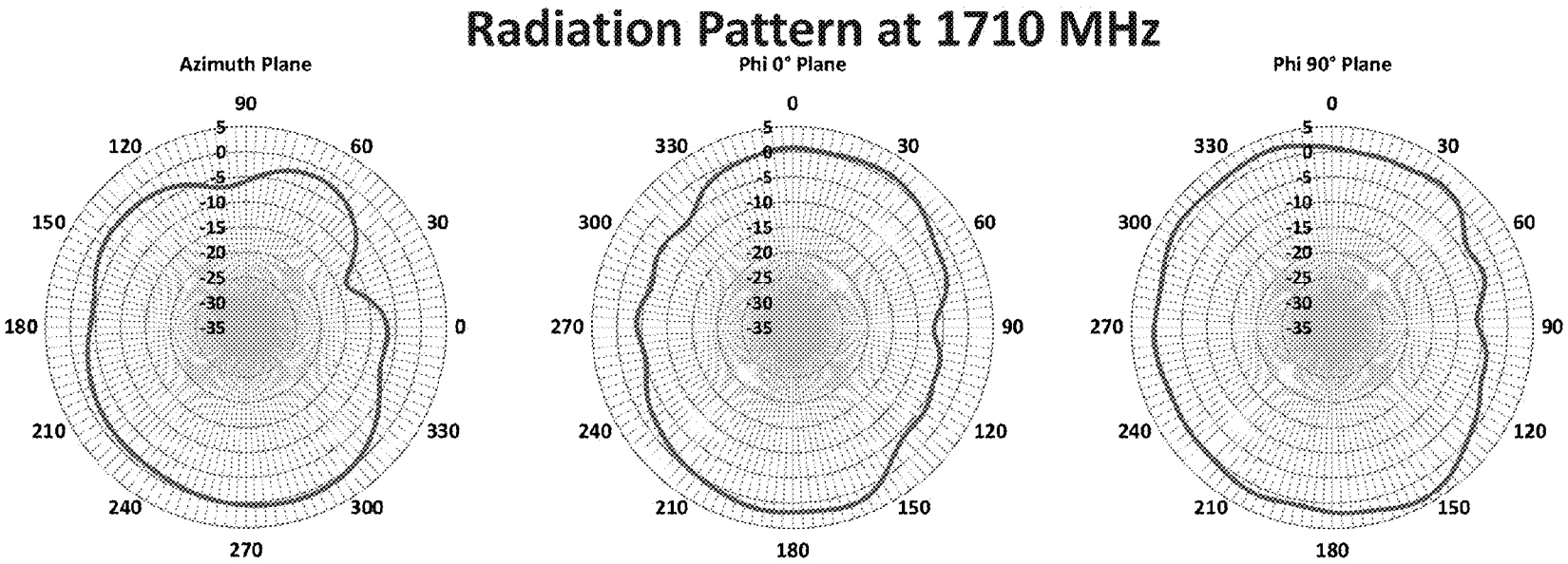
Figure 49:
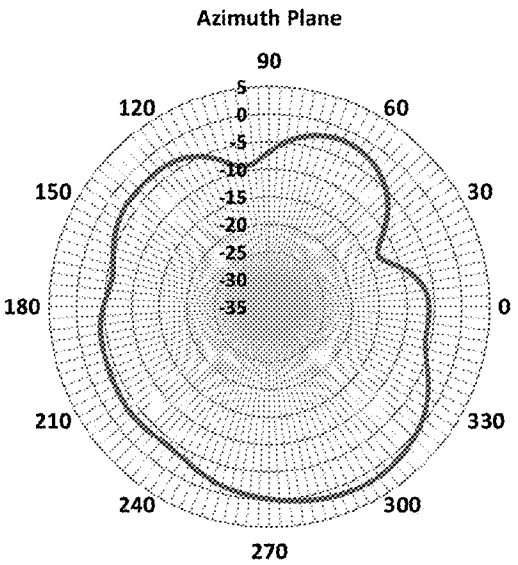
Figure 50:
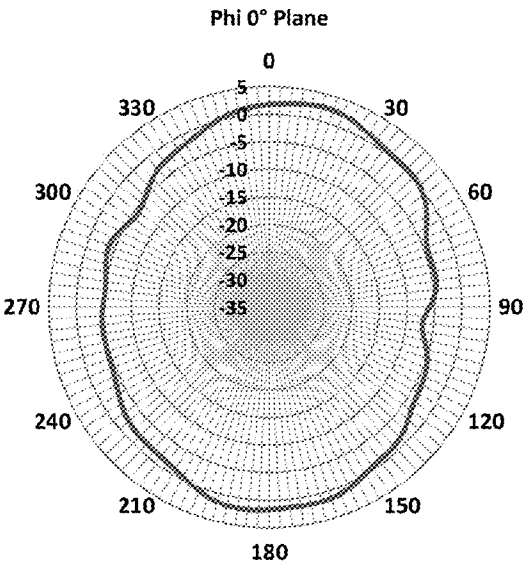
Figure 51:
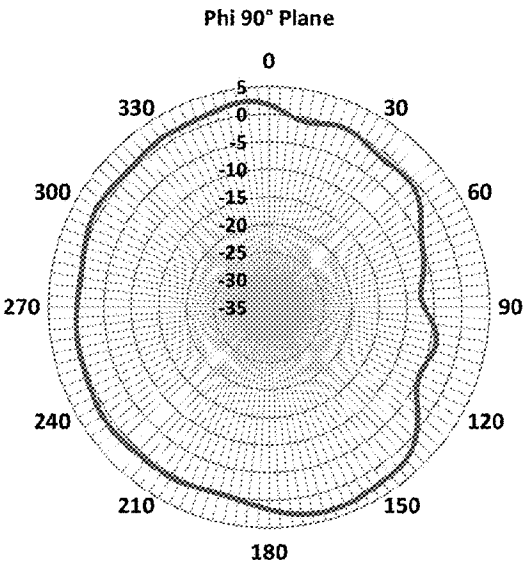
Figure 52:
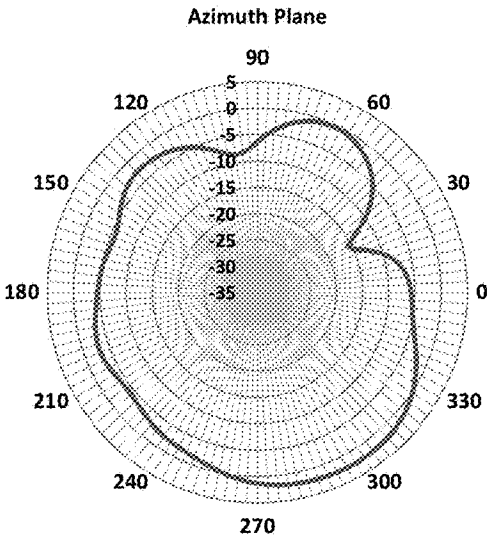
Figure 53:
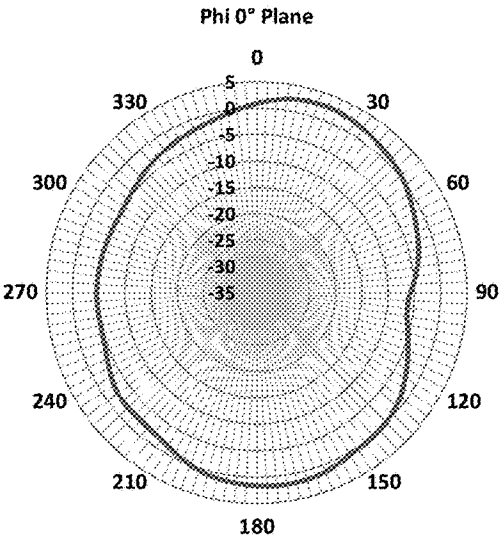
Figure 54:
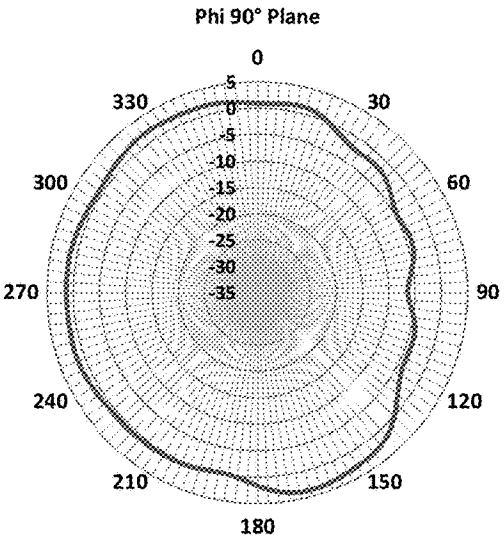
Figures 55, 56, 57:
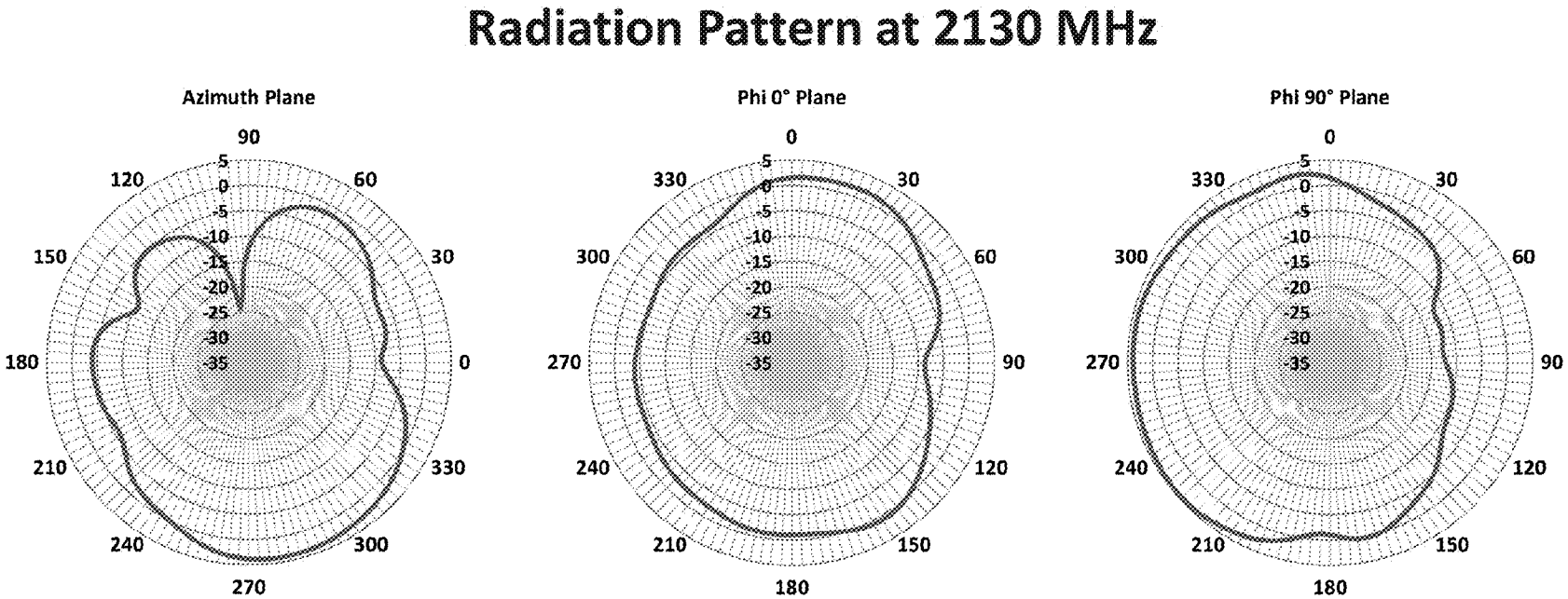
Figure 58:
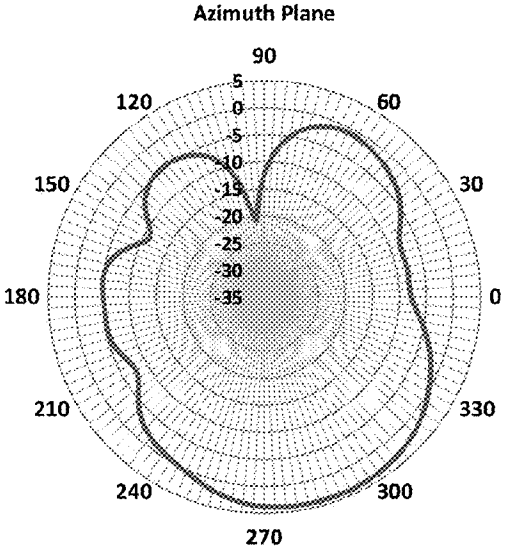
Figure 59:
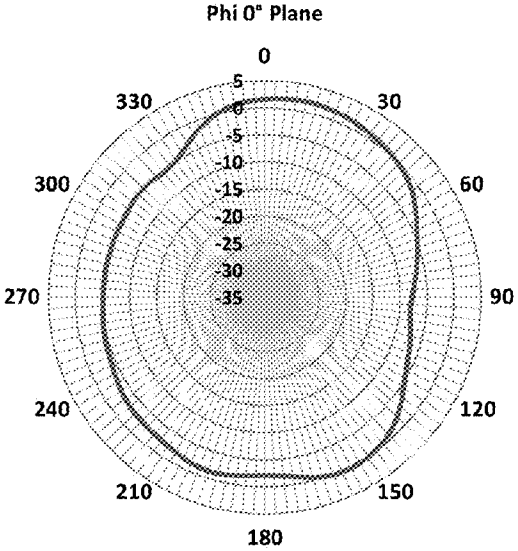
Figure 60:
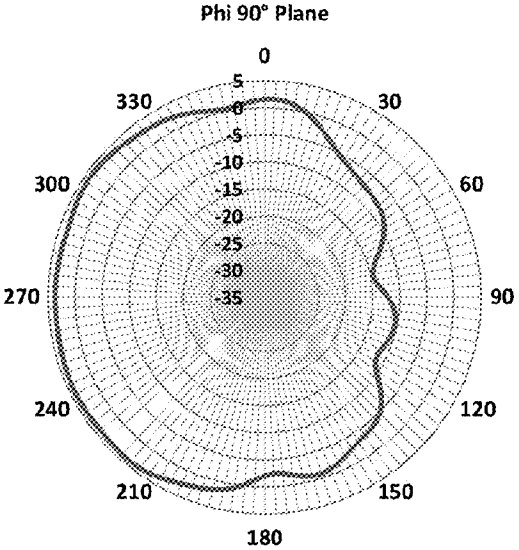
Figures 61, 62, 63:
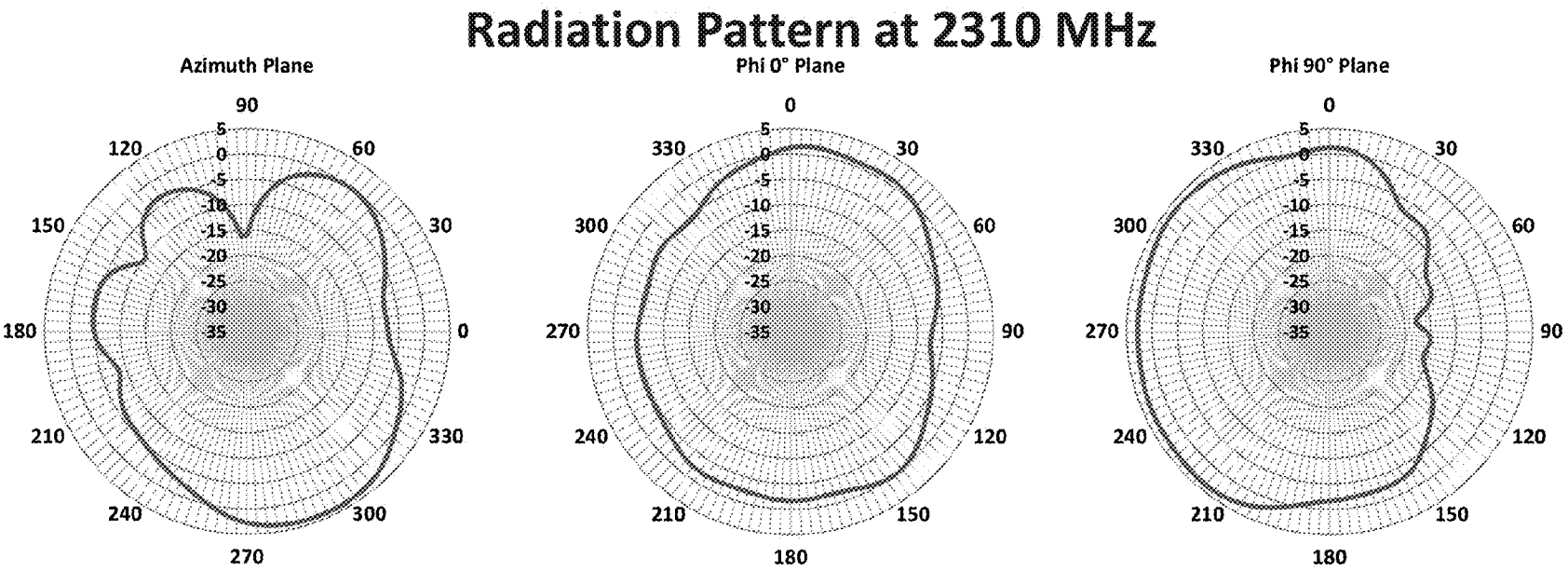
Figure 64:
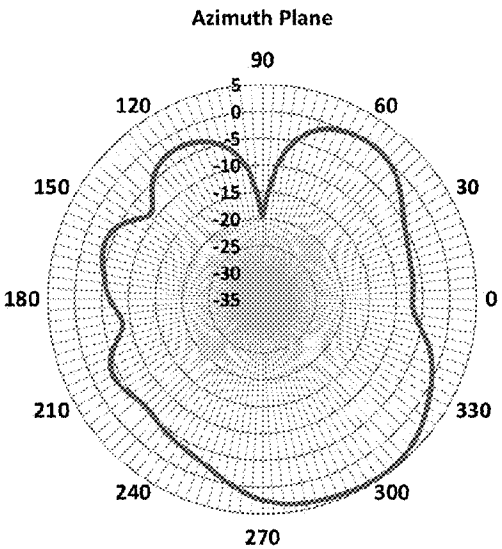
Figure 65:
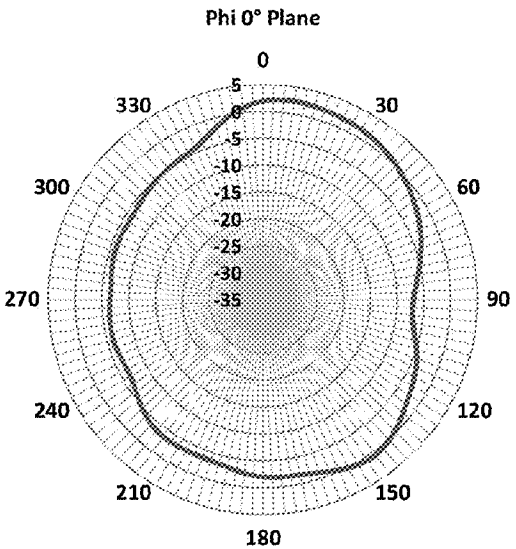
Figure 66:
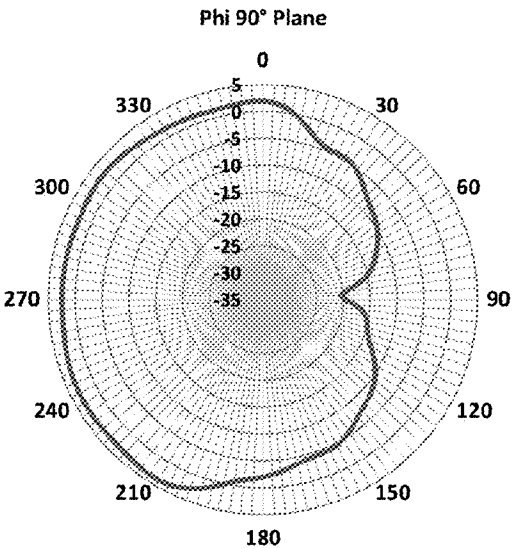
Figure 67:
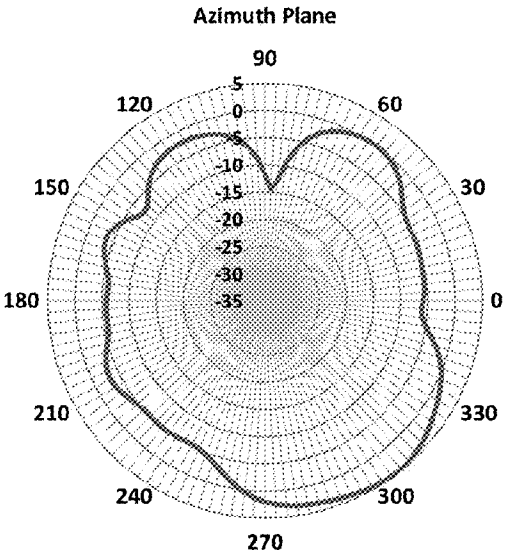
Figure 68:
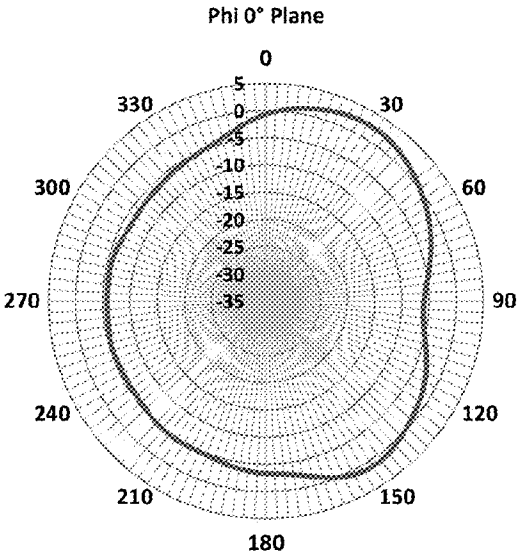
Figure 69:
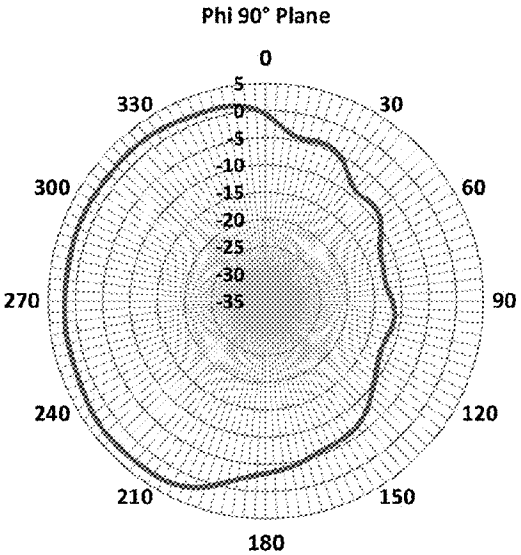
Figure 70:
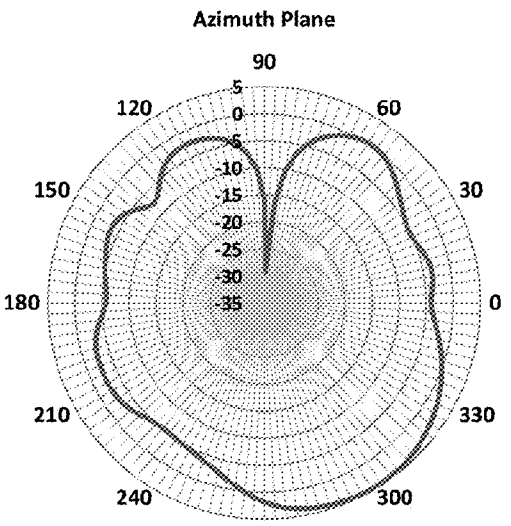
Figure 71:
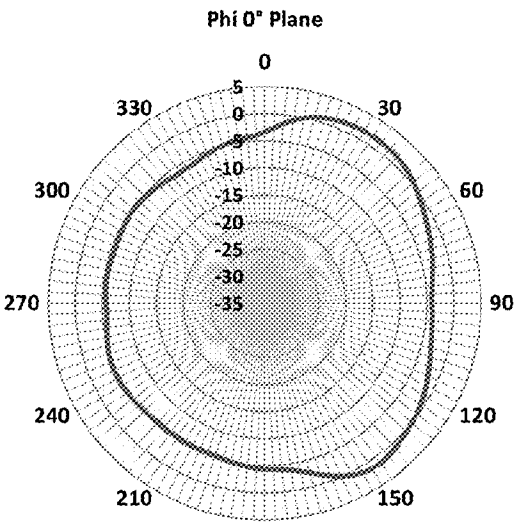
Figure 72:
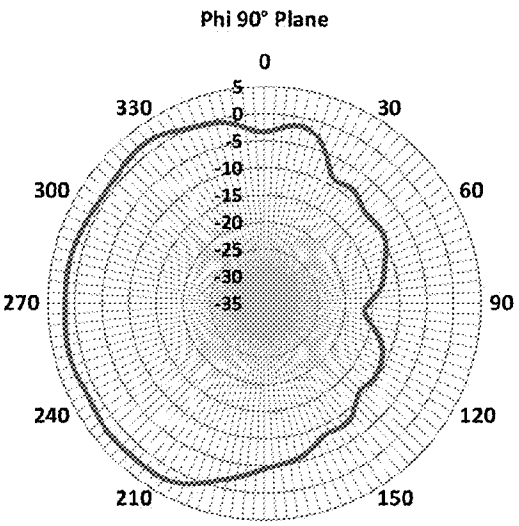
Figure 73:
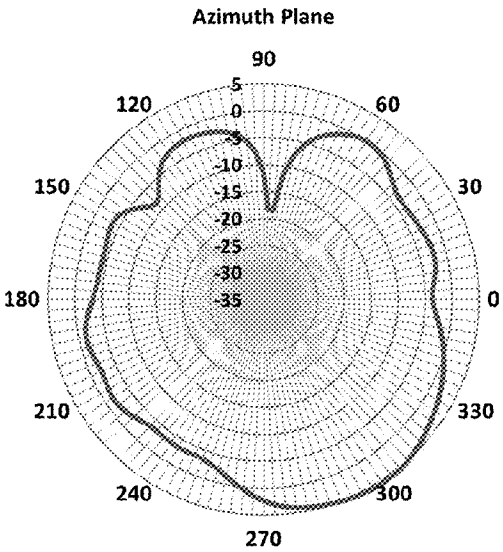
Figure 74:
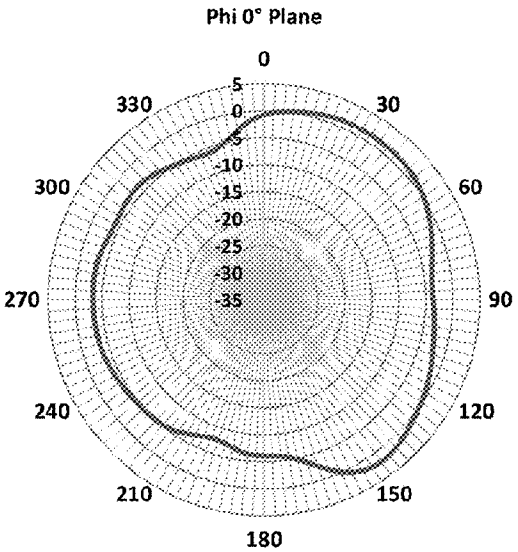
Figure 75:
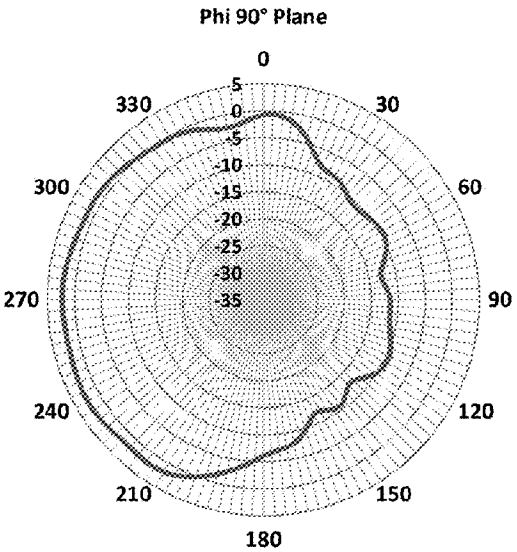
Figure 76:
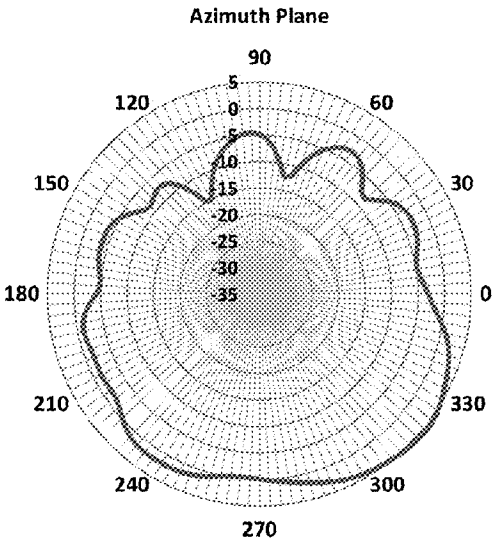
Figure 77:
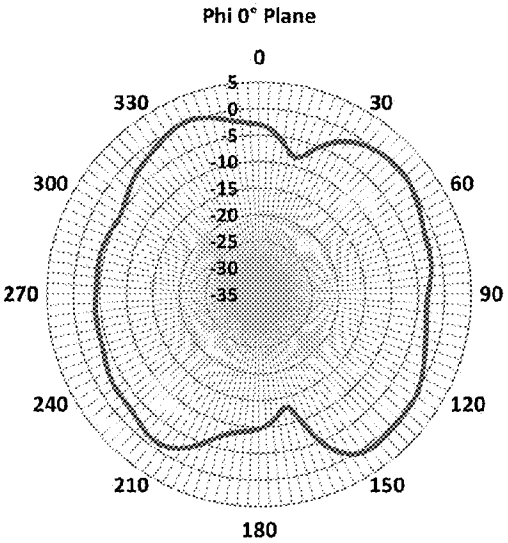
Figure 78:
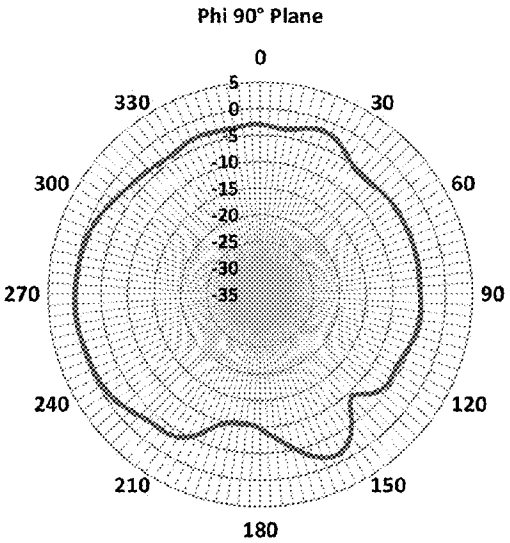
Figure 79:
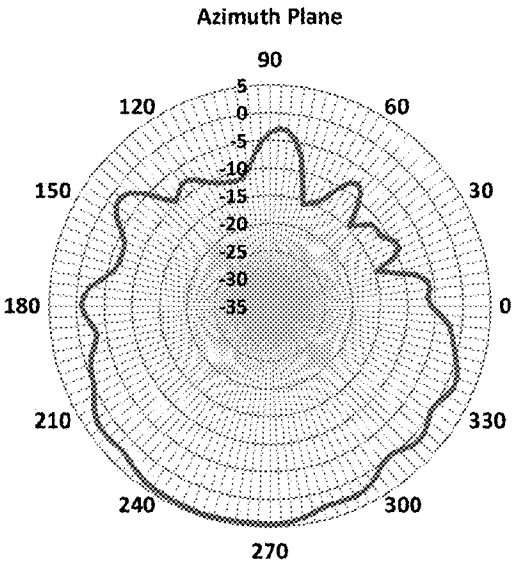
Figure 80:
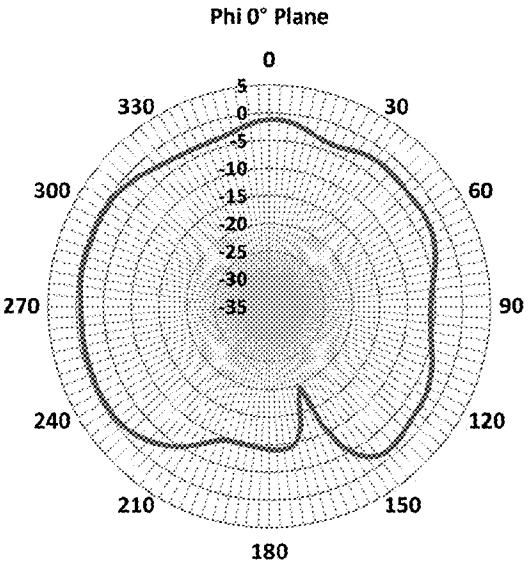
Figure 81:
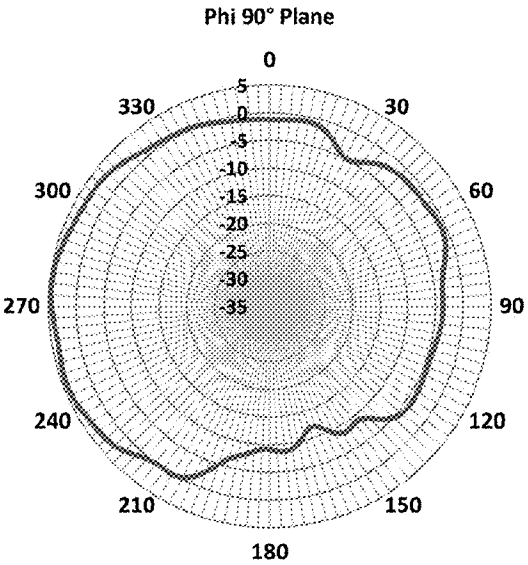
Figure 82:
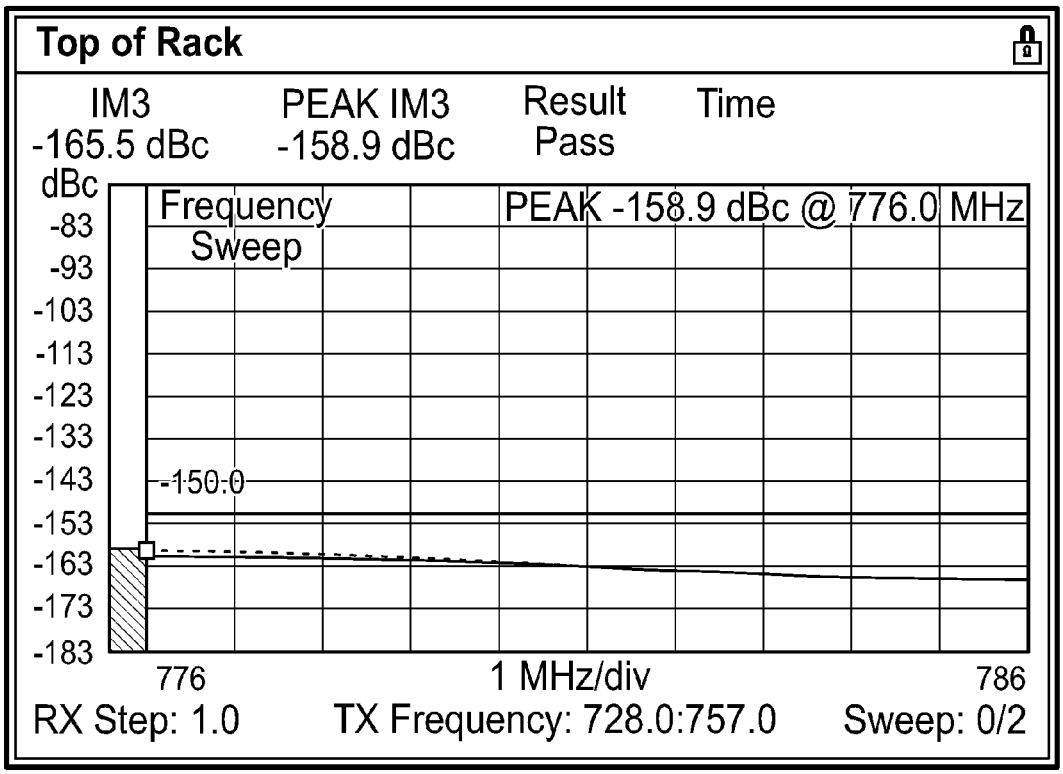
Figure 83:
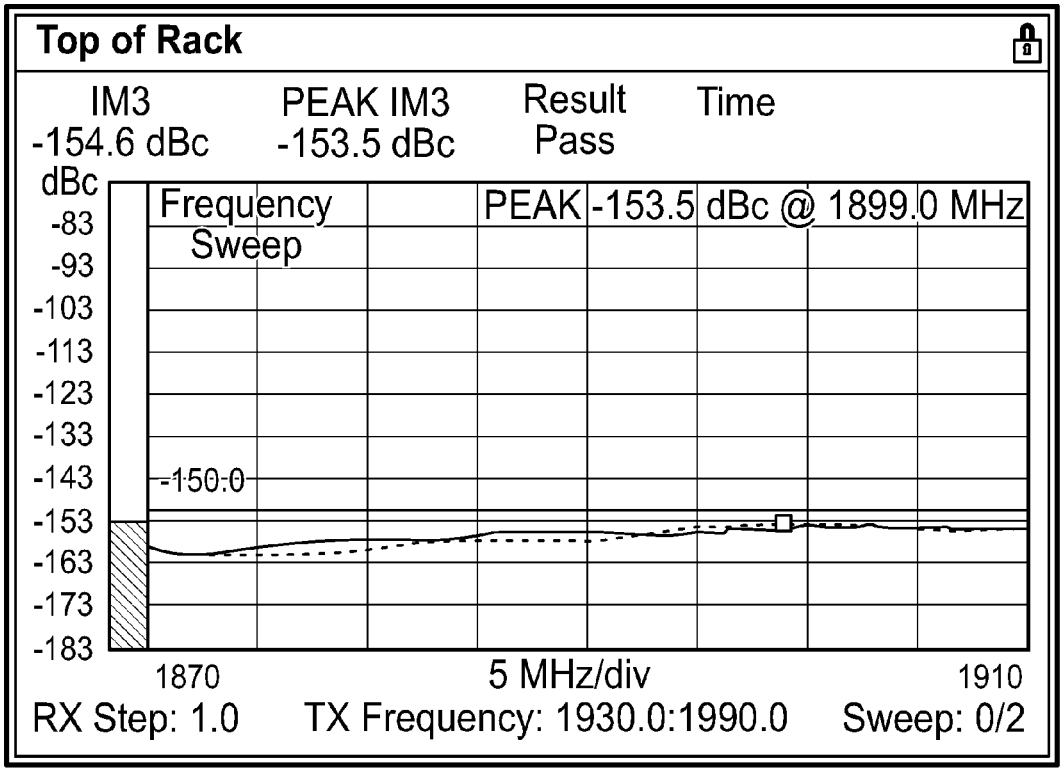
Figure 84:
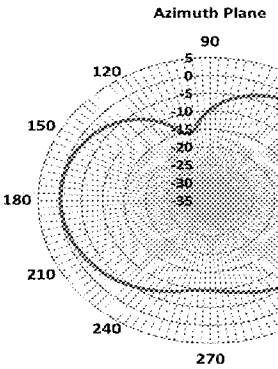
Figure 85:
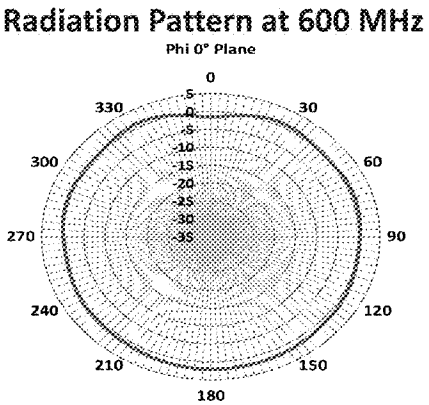
Figure 86:
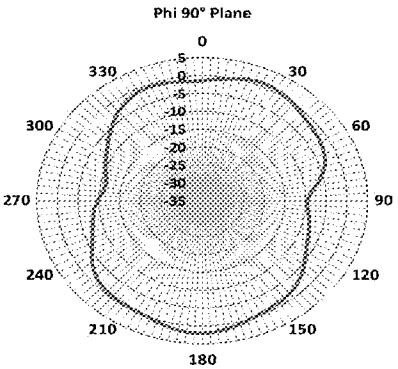
Figure 87:
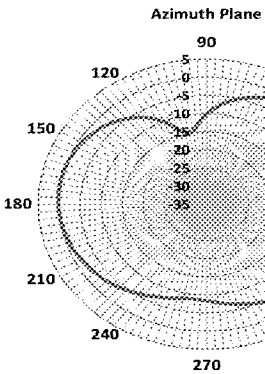
Figure 88:
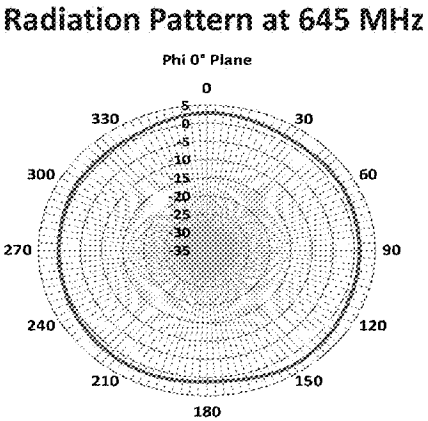
Figure 89:
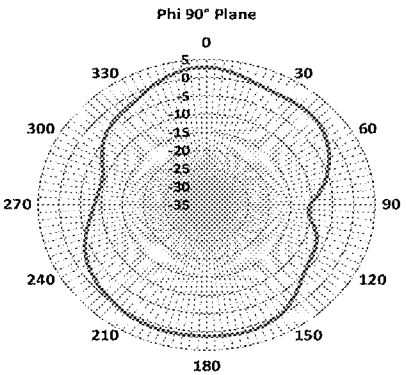
Figure 90:
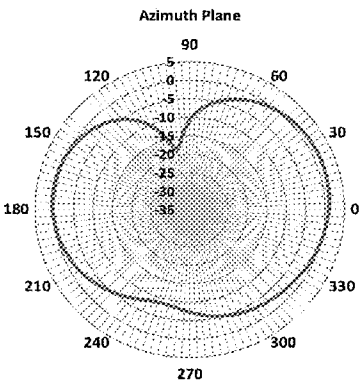
Figure 91:
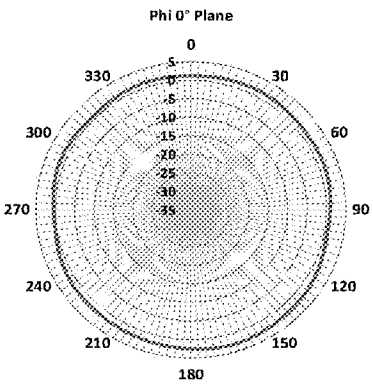
Figure 92:
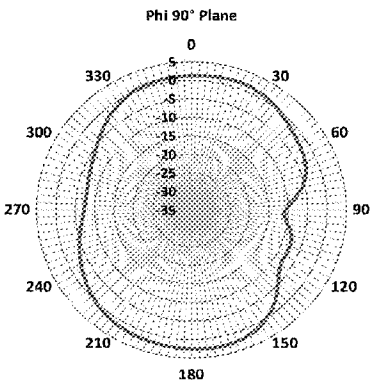
Figure 93:
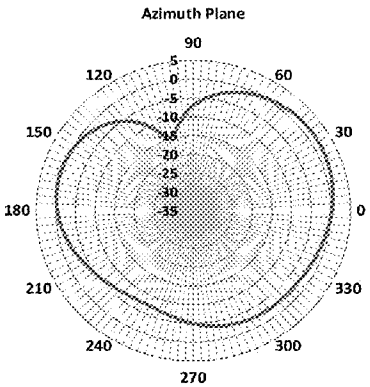
Figure 94:
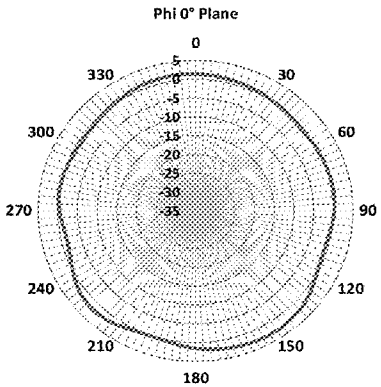
Figure 95:
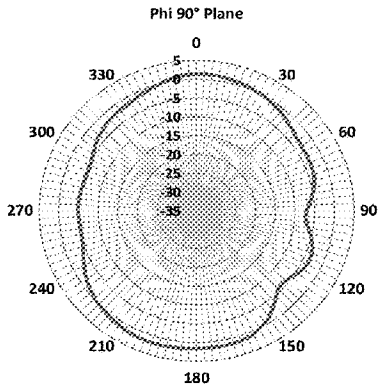
Figure 96:
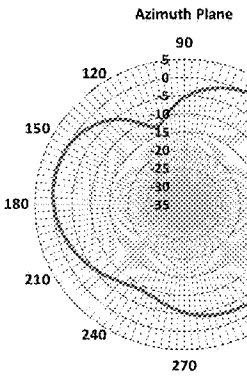
Figure 97:
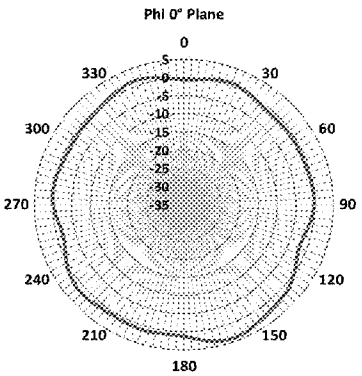
Figure 98:
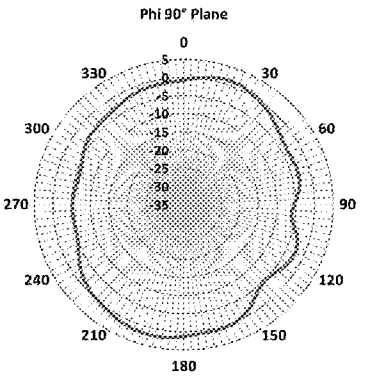
Figure 99:
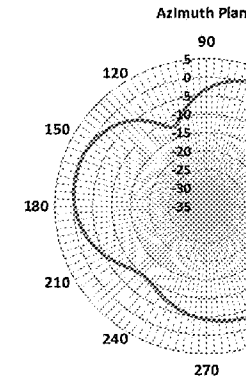
Figure 100:
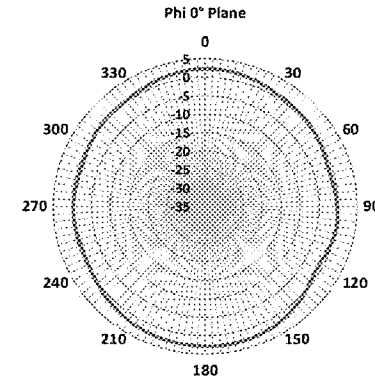
Figure 101:
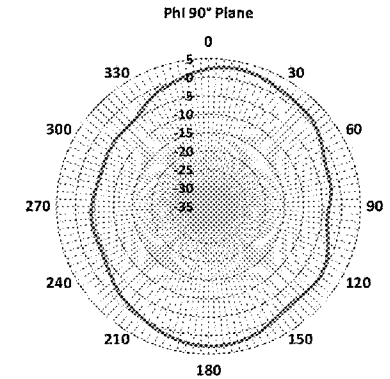
Figure 102:
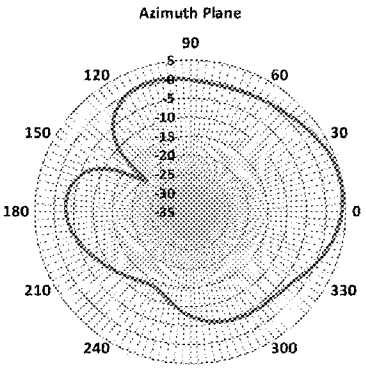
Figure 103:
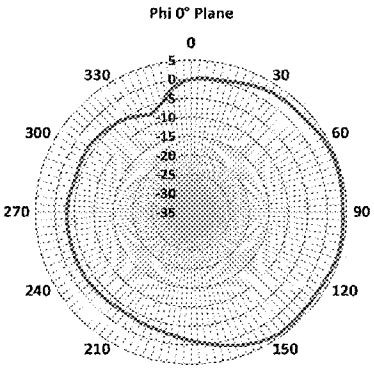
Figure 104:
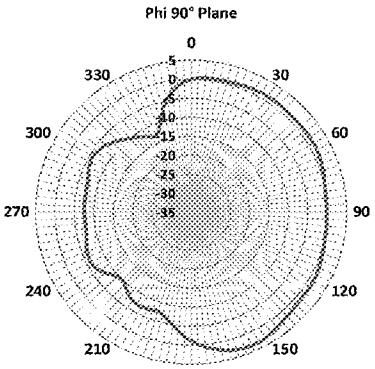
Figure 105:
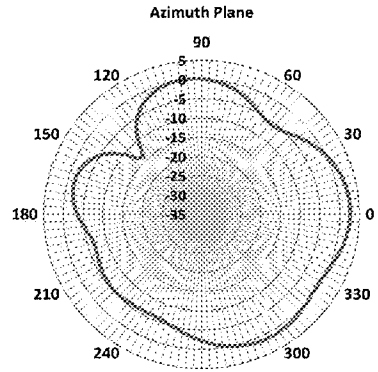
Figure 106:
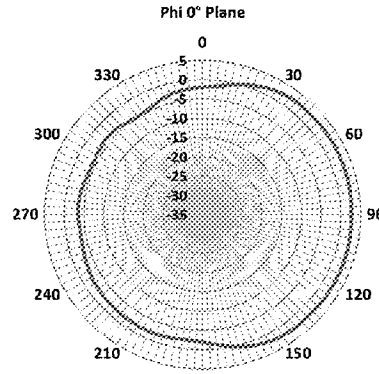
Figure 107:
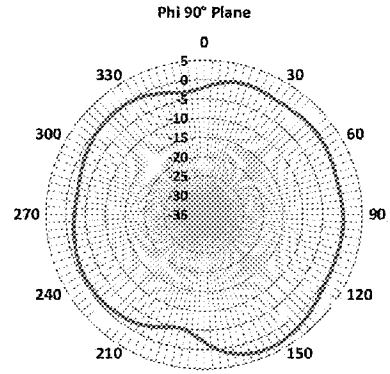
Figure 108:
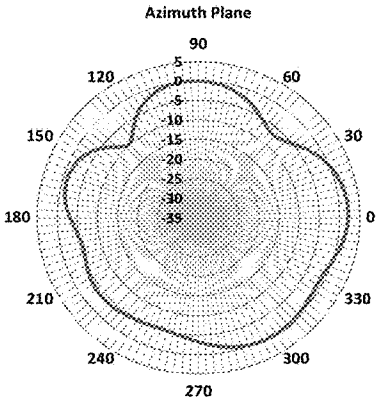
Figure 109:
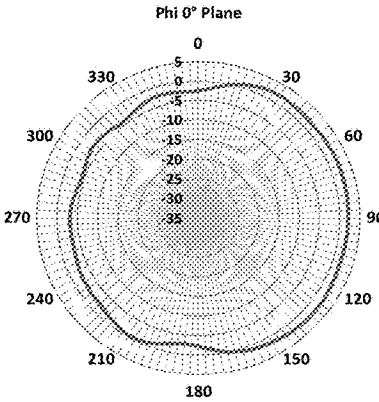
Figure 110:
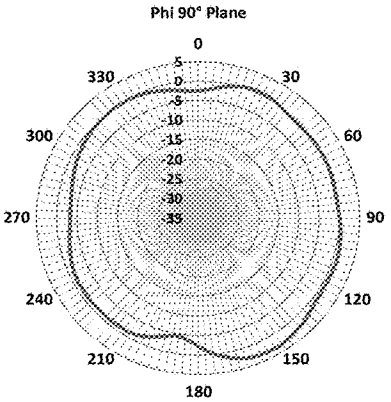
Figure 111:
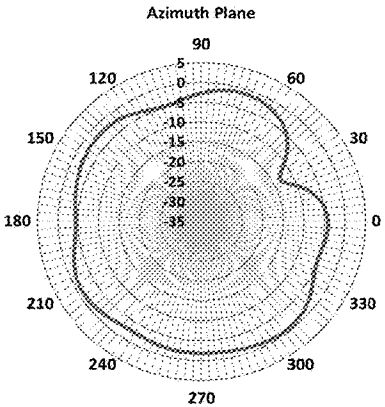
Figure 112:
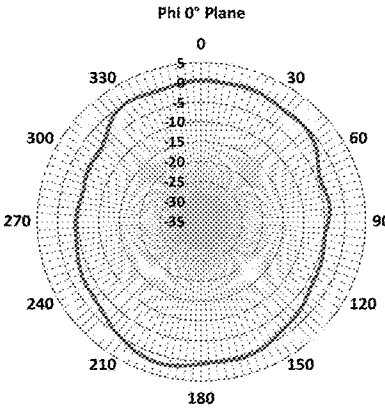
Figure 113:
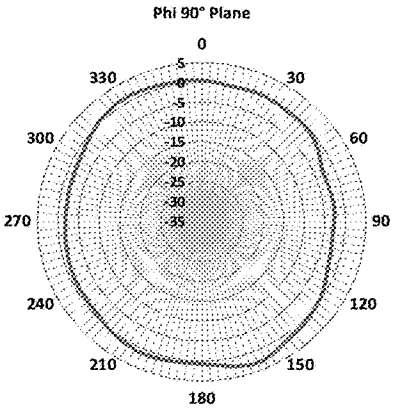
Figure 116:
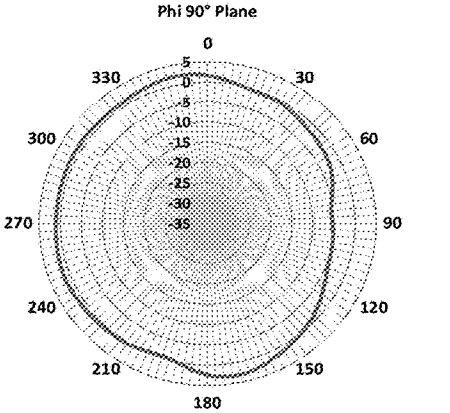
Figure 115:
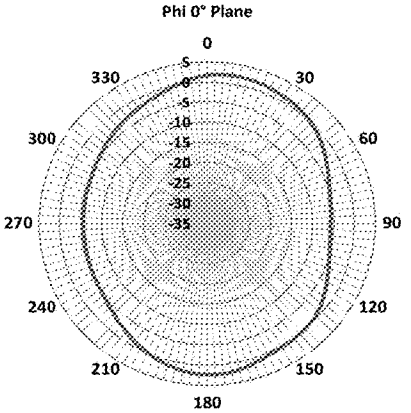
Figure 114:
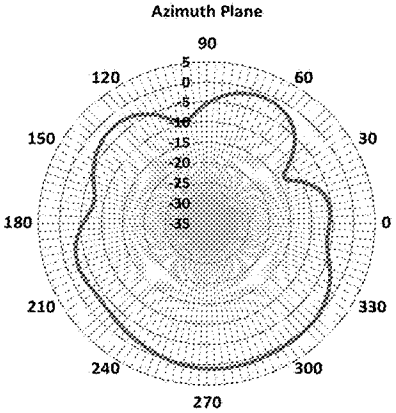
Figure 119:
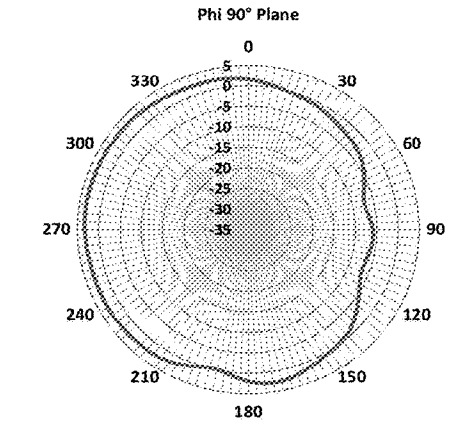
Figure 118:
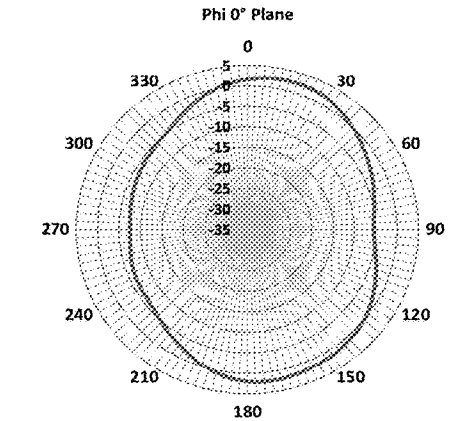
Figure 117:
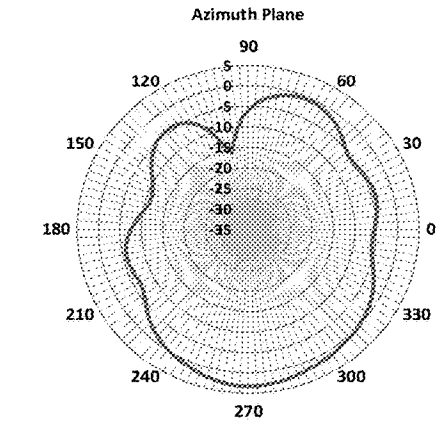
Figure 122:
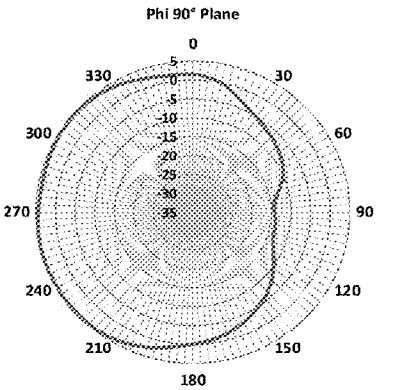
Figure 121:
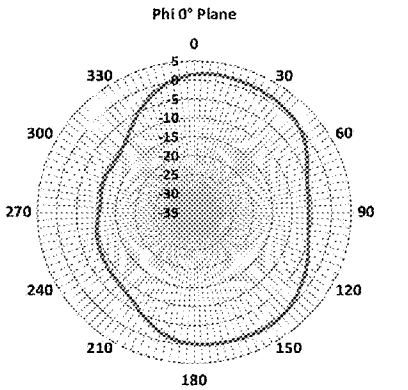
Figure 120:
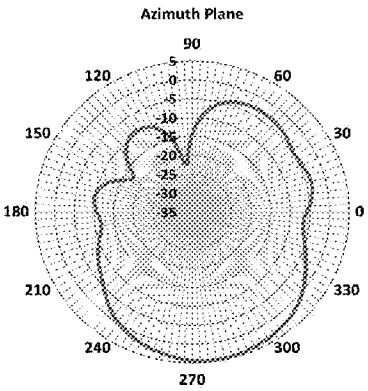
Figure 125:
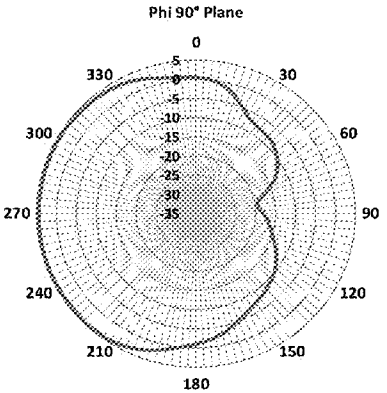
Figure 124:
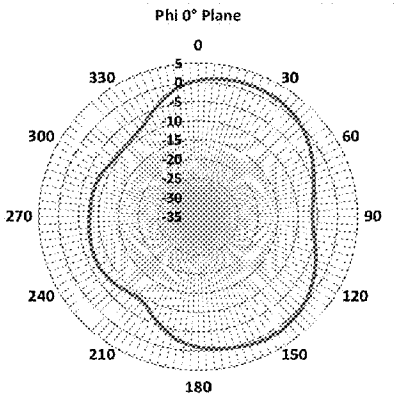
Figure 123:
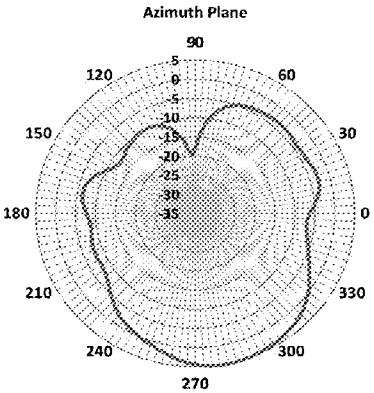
Figure 126:
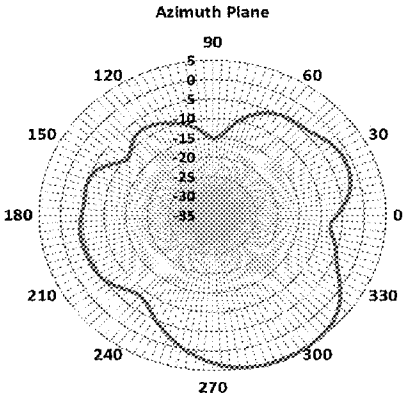
Figure 127:
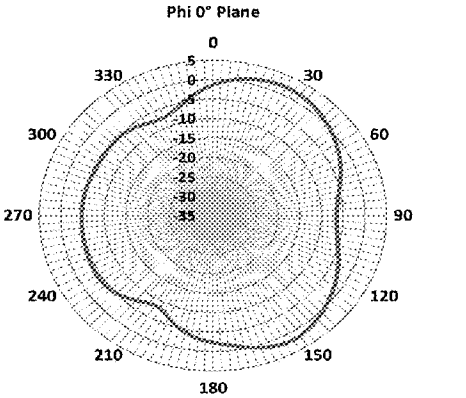
Figure 128:
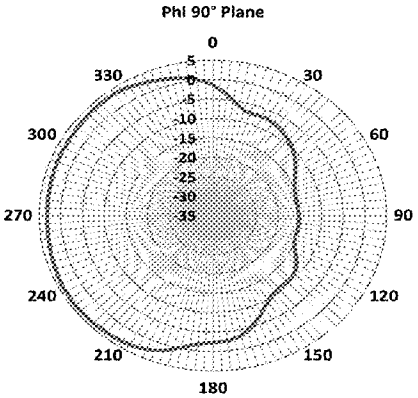
Figure 129:
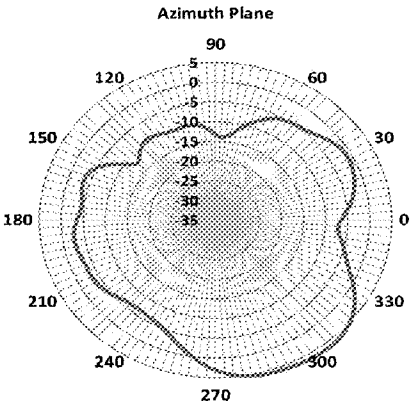
Figure 130:
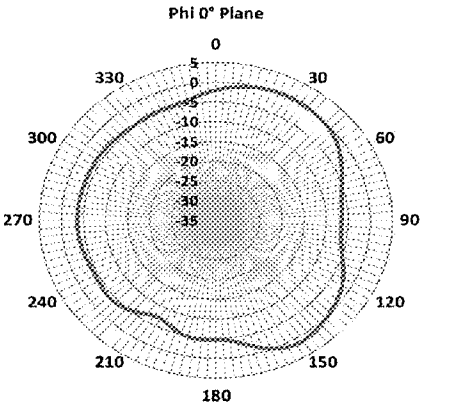
Figure 131:
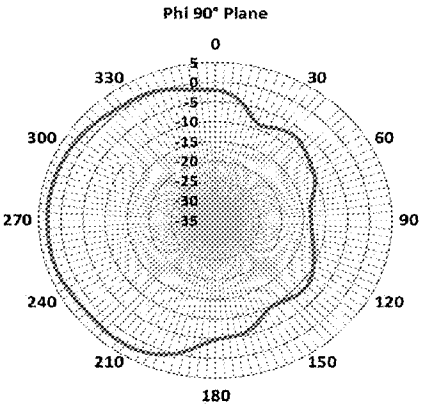
Figure 138:
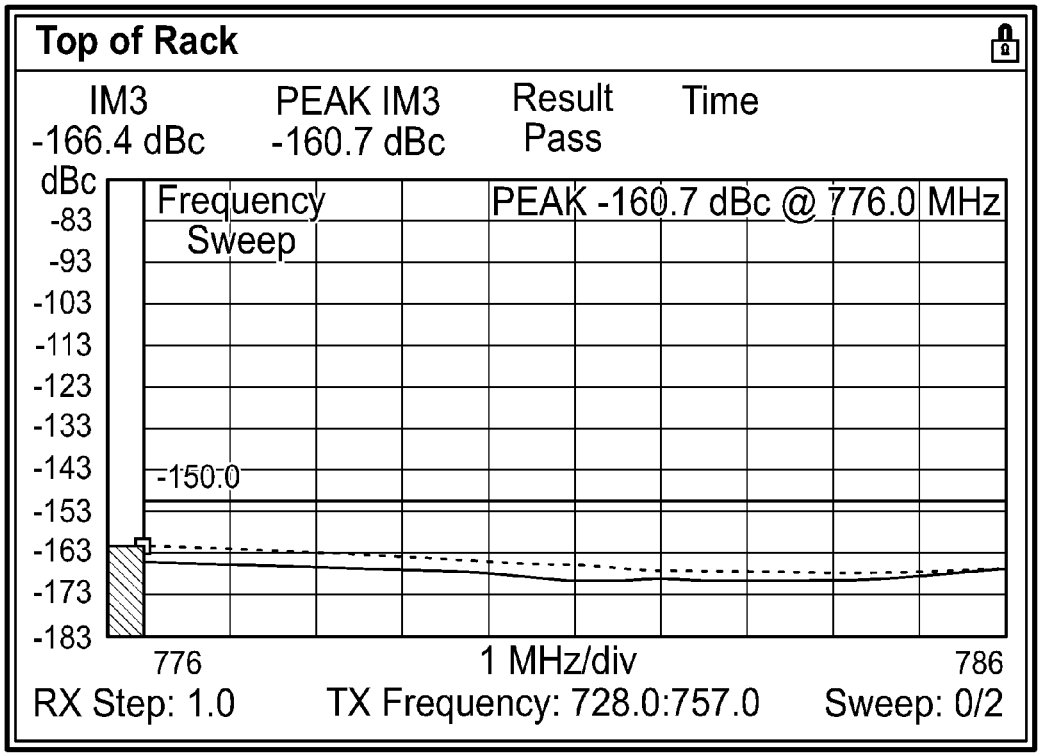
Figure 139:
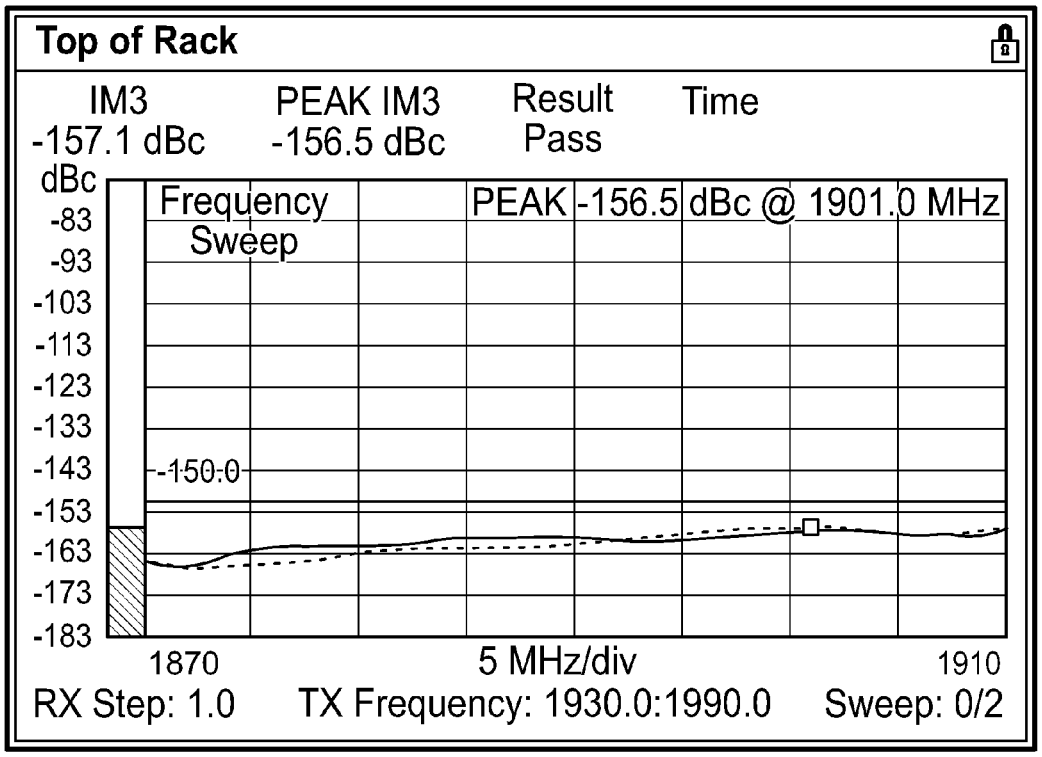
Figure 140:
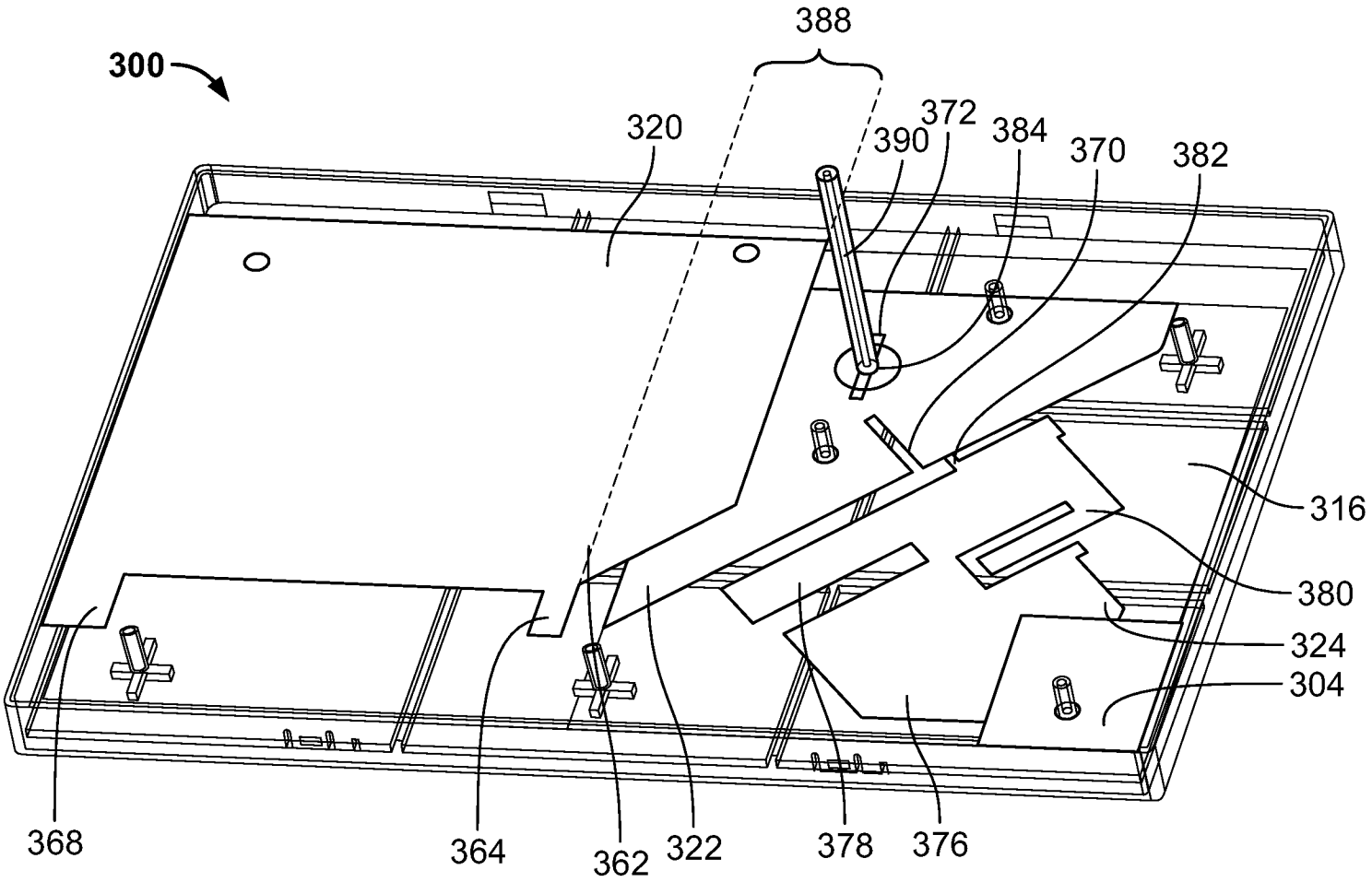
Figure 141:
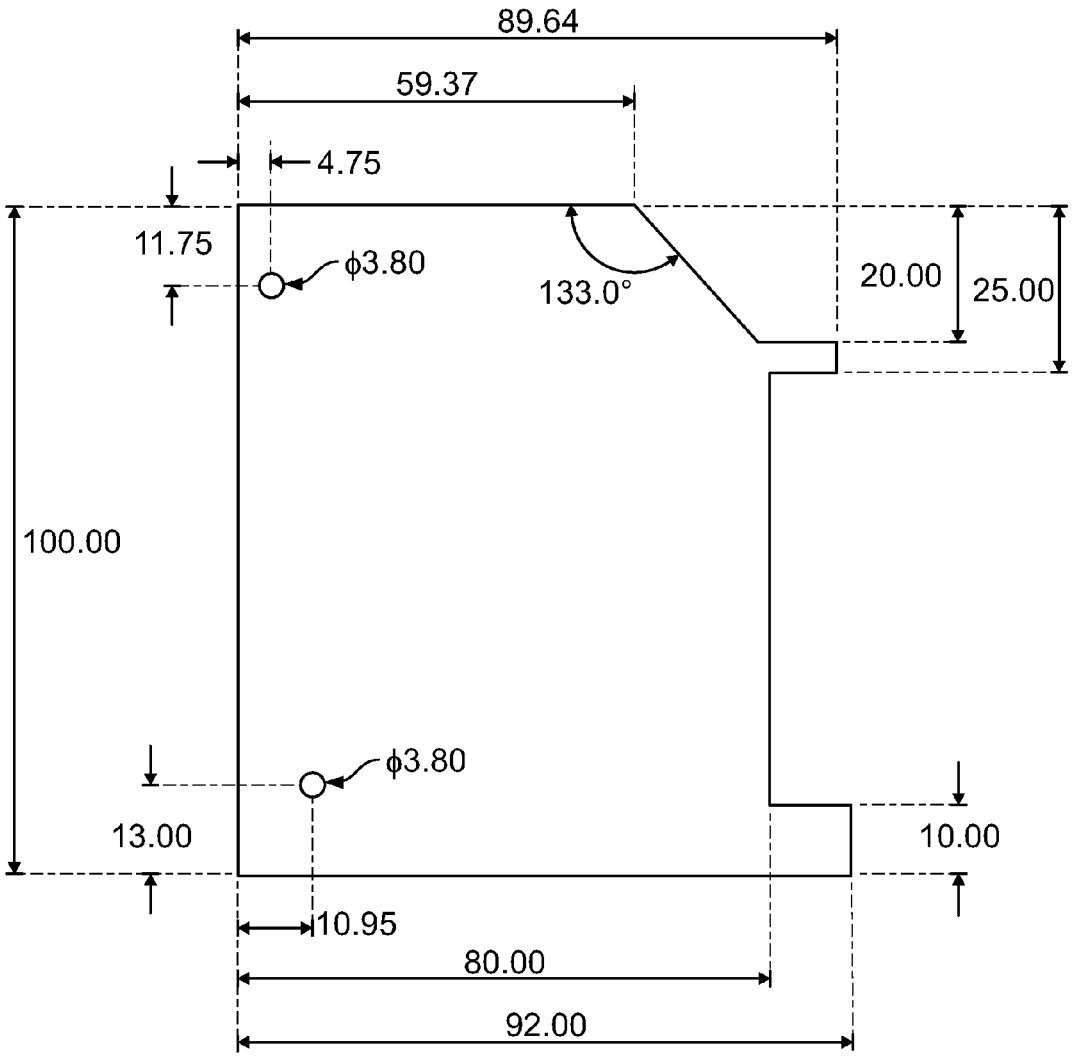
Figure 142:
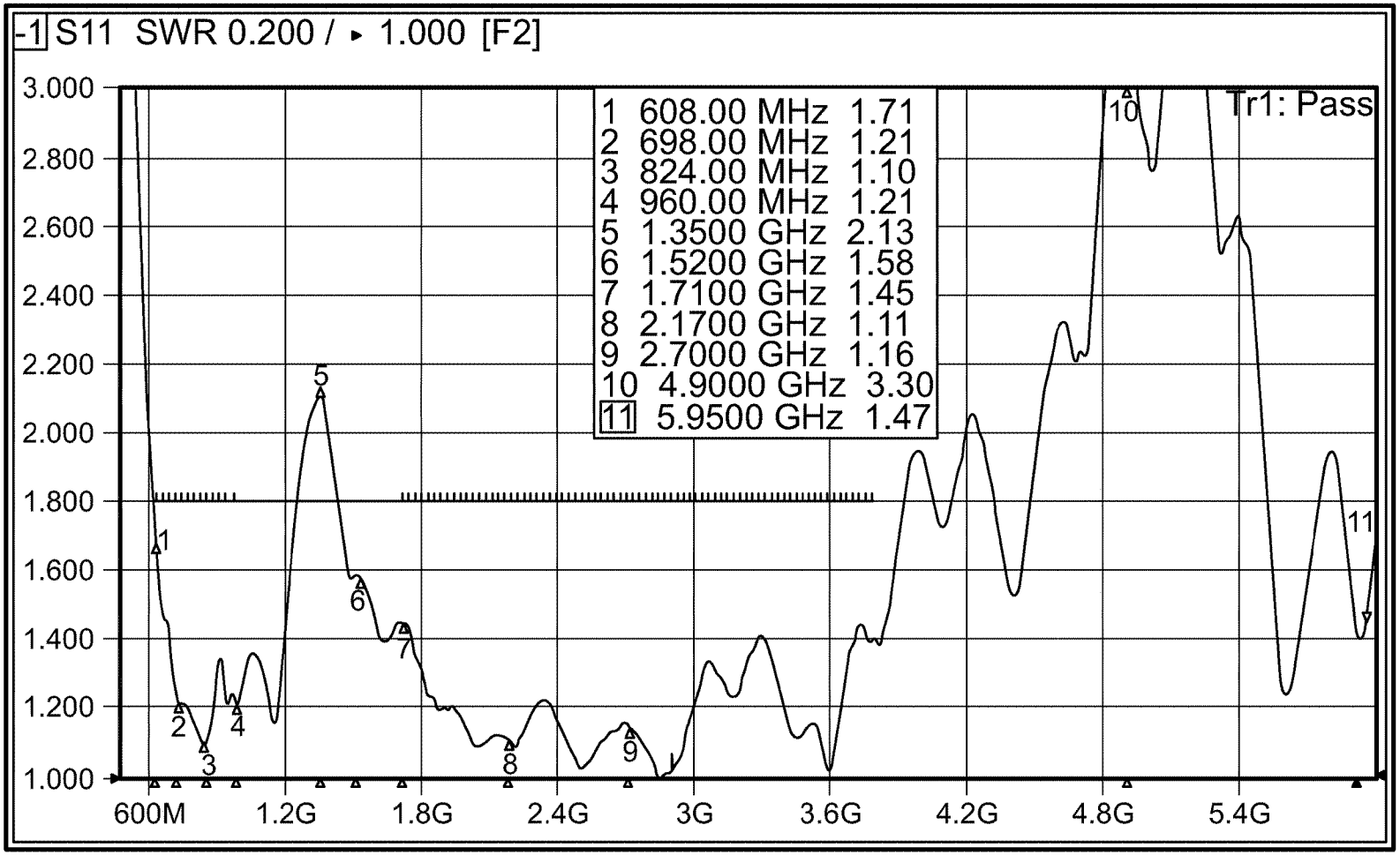
Figure 143:
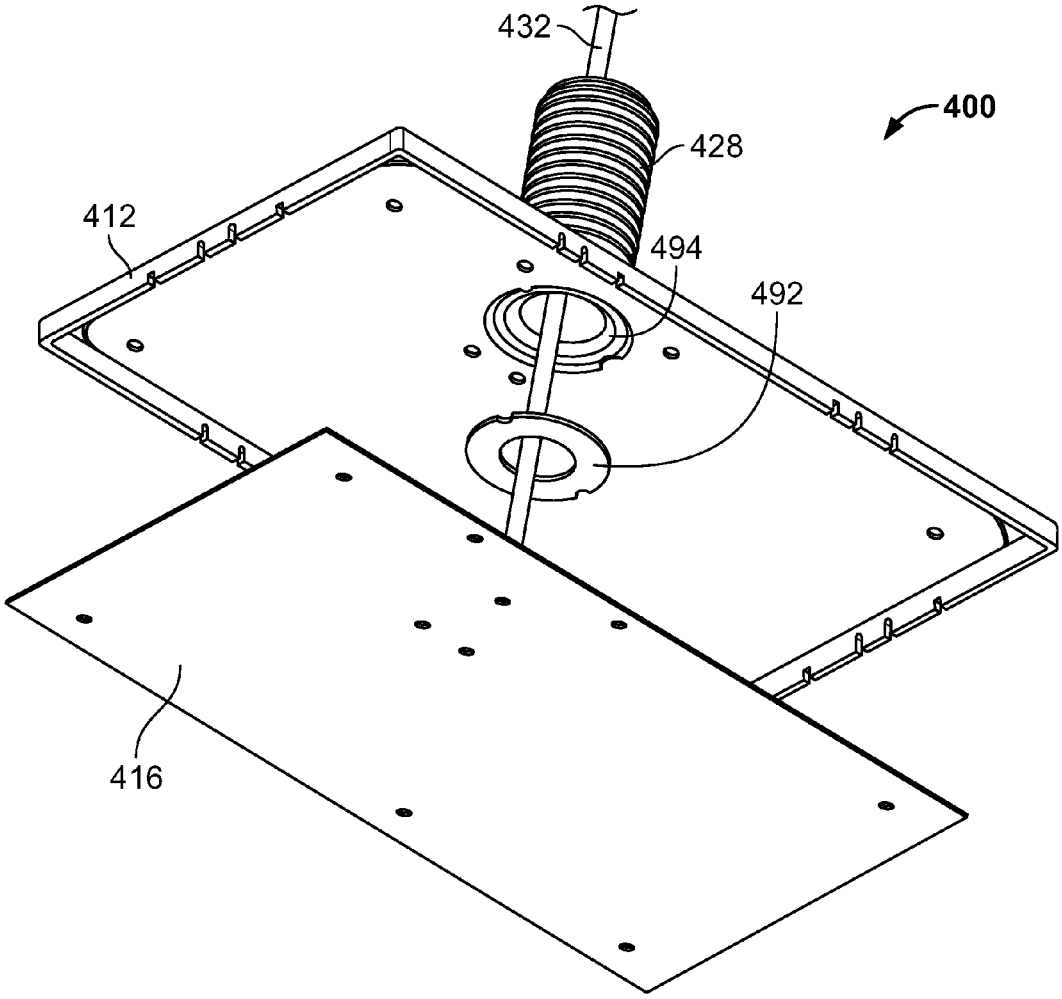
Figure 144:
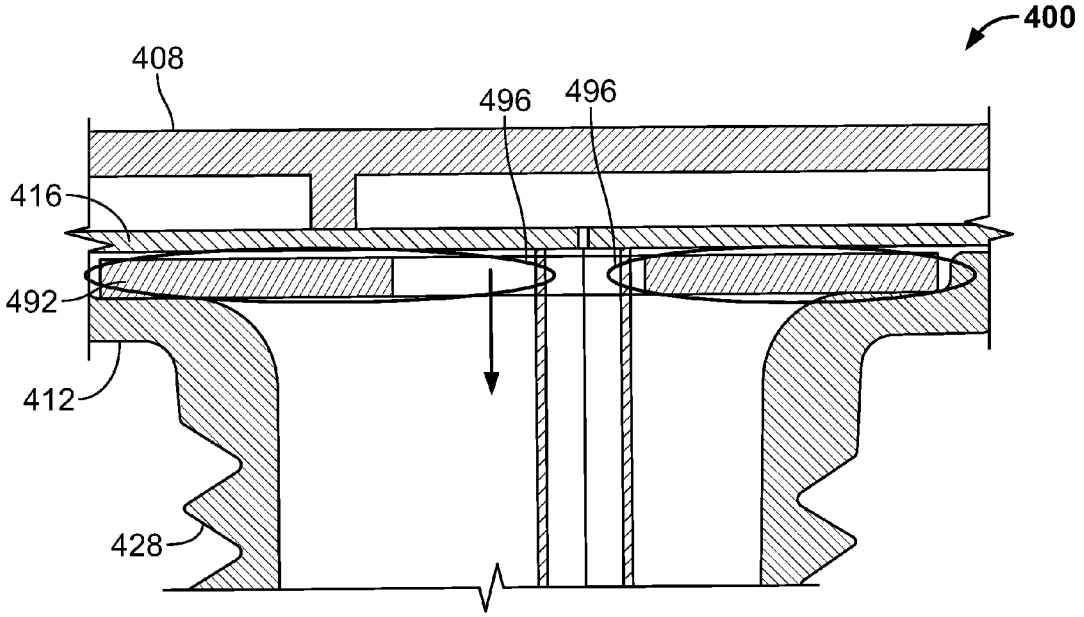

FIGS. 10, 11, and 12 are respective back, side, and front views of the PCB shown in FIGS. 8 and 9 where exemplary dimensions (in millimeters) are provided for purposes of illustration only according to an exemplary embodiment;

FIG. 13 is a perspective view of a PCB that may be used with the antenna shown in FIGS. 1 through 3 according to another exemplary embodiment in which the PCB includes a radiator and a ground plane along opposite front and back sides of the PCB but does not include a patch along the back side of the PCB;

FIGS. 14A and 14B are respective back and side views of the PCB shown in FIG. 13 where exemplary dimensions (in millimeters) are provided for purposes of illustration only according to an exemplary embodiment;

FIG. 15A is an exemplary line graph of voltage standing wave ratio (VSWR) versus frequency in megahertz (MHz) measured for a prototype antenna as shown in FIGS. 1 through 3 with the PCB as shown in FIGS. 14A and 14B that did not include a patch along the back side of the PCB;

FIG. 15B is an exemplary line graph of voltage standing wave ratio (VSWR) versus frequency in megahertz (MHz) measured for a prototype antenna as shown in FIGS. 1 through 3 with the PCB as shown in FIGS. 10 through 12 including the patch along the back side of the PCB;

FIGS. 16 through 81 illustrate radiation patterns (azimuth plane, Phi 0° plane, and Phi 90° plane) at various frequencies measured for a prototype antenna as shown in FIGS. 1 through 3 with the PCB as shown in FIGS. 14A and 14B that did not include a patch along the back side of the PCB;

FIGS. 82 and 83 are exemplary line graphs of passive intermodulation level (PIM) in decibels relative to carrier (dBc) versus frequency in megahertz (MHz) measured for a prototype antenna as shown in FIGS. 1 through 3 with the PCB as shown in FIGS. 14A and 14B that did not include a patch along the back side of the PCB, and showing PIM (IM3) performance for two transmitted carriers (20W each) at respective transmission (Tx) frequencies of 728 MHz to 757 MHz and 1930 MHz to 1990 MHz;

FIGS. 84 through 137 illustrate radiation patterns (azimuth plane, Phi 0° plane, and Phi 90° plane) at various frequencies measured for a prototype antenna as shown in FIGS. 1 through 3 with the PCB as shown in FIGS. 10 through 12 including the patch along the back side of the PCB;

FIGS. 138 and 139 are exemplary line graphs of passive intermodulation level (PIM) in decibels relative to carrier (dBc) versus frequency in megahertz (MHz) measured for a prototype antenna as shown in FIGS. 1 through 3 with the PCB as shown in FIGS. 10 through 12 including the patch along the back side of the PCB, and showing PIM (IM3) performance for two transmitted carriers (20W each) at respective transmission (Tx) frequencies of 728 MHz to 757 MHz and 1930 MHz to 1990 MHz;

FIG. 140 illustrates a low profile wideband/multiband omnidirectional SISO antenna according to another exemplary embodiment that includes a radiator along a PCB and an electrically-conductive tape or foil, wherein the electrically-conductive tape or foil is coupled to a ground of the radiator via proximity coupling and electrically insulated by the masking of the PCB itself;

FIG. 141 provides exemplary dimensions in millimeters and angles in degrees for the electrically-conductive tape or foil shown in FIG. 140, which are provided for purposes of illustration only according to an exemplary embodiment;

FIG. 142 is an exemplary line graph of voltage standing wave ratio (VSWR) versus frequency in megahertz (MHz) measured for a prototype of the antenna shown in FIG. 140;

FIG. 143 is an exploded perspective view of a low profile wideband/multiband omnidirectional SISO antenna according to another exemplary embodiment in which a dielectric spacer is positioned between the baseplate or support member and a PCB generally around an opening of the threaded stud of the baseplate; and FIG. 144 is a partial cross-sectional side view of the antenna shown in FIG. 143 after the PCB and dielectric spacer have been positioned within an interior enclosure cooperatively defined between the baseplate and a radome.

Corresponding reference numerals indicate corresponding parts throughout the several views of the drawings.

DETAILED DESCRIPTION

Example embodiments will now be described more fully with reference to the accompanying drawings.

Disclosed herein are exemplary embodiments of low profile wideband and/or multiband omnidirectional SISO antennas. In some exemplary embodiments, the antenna is configured for wideband operation such that the antenna is operable within a wide frequency range (e.g., from about 600 MHz to about 3800 MHz, across most of the Long Term Evolution (LTE) band, etc.). In other exemplary embodiments, the antenna is configured for multiband operation such that the antenna is operable within at least a first frequency range (e.g., from about 698 MHz to about 960 MHz, etc.) and a second frequency range (e.g., from about 1350 MHz to about 1525 MHz, from about 1690 MHz to about 3800 MHz, from about 1350 MHz to 3800 MHz, etc.) different than the first frequency range. For example, the antenna may be operable within a first frequency range from about 698 MHz to about 960 MHz, a second frequency range from about 1350 MHz to about 1525 MHz, and a third frequency range from about 1690 MHz to about 3800 MHz. In other possible exemplary embodiments, the antenna may cover more than the frequency ranges mentioned above (e.g., 600 to 6000 MHz, etc.) with some tradeoff of the radiation pattern null.

In exemplary embodiments, the antenna includes a radiator within an interior cooperatively defined between a radome and a baseplate or support member. The baseplate may include a threaded stud feature (broadly, a mounting feature or fixture) for installing the antenna to a ceiling (broadly, a mounting surface). The radiator may comprise a PCB radiator, stamped radiator, flexible PCB radiator, combination thereof, etc. For example, the antenna may include a radiator and a ground plane (broadly, a ground element) along opposite first and second (or front and back) sides of a PCB (broadly, a substrate).

In exemplary embodiments, the antenna may include asymmetrical arms (e.g., arms 120 and 124 along opposite sides of a PCB as shown in FIGS. 8 and 9, etc.) and thus is not a typical dipole antenna having symmetrical arms. The longer/larger asymmetrical arm may be referred to as a ground plane while the other asymmetrical arm may be referred to as the radiator.

The inventors hereof have recognized that there are several factors that play important roles to have reduced null and more omnidirectional radiation patterns at azimuth plane for a horizontal planar asymmetrical dipole antenna as disclosed herein:

- ratio of the length between the radiator and the ground plane;
- the edge angle of the ground plane against the radiator;
- the location of the feeding point; and
- the length of one of the radiator arms.

The inventors hereof have also recognized that there are also several factors to maintain the reduced null and more omnidirectional radiation patterns at azimuth plane for a horizontal planar asymmetrical dipole antenna while broadbanding the antenna bandwidth:

- wide arm or ground plane of the antenna;
- coupling between the arm and the ground plane;
- impedance matching via a slot introduced to an edge of the ground plane that overlaps the radiator;
- a slot introduced adjacent the solder location of the feeding cable; and
- width and length of the transmission line.

The inventors hereof have further recognized that there are several factors to lengthen the antenna electrically without significantly increasing antenna size when having a lower frequency option to cover frequencies from 600 MHz:

- slight lengthening of the trace defining the ground plane;
- extension of the radiator via suspended loading or proximity trace (broadly, a patch) to increase the electrical length; and
- having additional dielectric loading provided by at least one rib within or under the radome at predetermined or certain locations.

The inventors hereof have additionally recognized that there are several factors that lower the risk of PIM level:

- using pigtail coaxial cable option instead of a fixed connector that has less freedom for matching the antenna; and
- slot(s) at the feeding ground point to reduce soldering surface.

Accordingly, disclosed herein are exemplary embodiments of antennas that may have or provide one or more of the following features or advantages over conventional dipole antennas. For example, a low profile wideband and/or multiband omnidirectional SISO antenna disclosed herein may have less null at azimuth plane as compared to a conventional dipole. A low profile wideband and/or multiband omnidirectional SISO antenna disclosed herein may also have a wide bandwidth, may enable a stable low PIM product, and/or may have a low profile as compared to other conventional antennas. Additionally, exemplary embodiments may include one or more features to realize or achieve low PIM level. For example, some exemplary embodiments may have an improved or low PIM level due to slots (broadly, openings) adjacent to the feeding ground point for the feeding cable that reduces the soldering surface.

With reference now to the figures, FIGS. 1, 2A, and 2B illustrate an exemplary embodiment of an omnidirectional SISO antenna 100 embodying one or more aspects of the present disclosure. As disclosed herein, the antenna 100 may be configured for wideband operation or multiband operation depending on whether or not the antenna 100 includes the patch 104 shown in FIGS. 4 and 8. When the antenna 100 includes the patch 104, the antenna 100 may be configured to be operable within a wideband frequency range (e.g., from about 600 MHz to about 3800 MHz, etc.). When the antenna 100 does not include the patch 104, the antenna 100 may be configured to be operable within multiple frequency ranges (e.g., a first frequency range from about 698 MHz to about 960 MHz, a second frequency range from about 1350 MHz to about 1525 MHz, and a third frequency range from about 1690 MHz to about 3800 MHz, etc.).

As shown in FIGS. 1 through 3, the antenna 100 includes a radome or cover 108 (e.g., a plastic flat rectangular radome, etc.) and a baseplate or support member 112 (e.g., plastic baseplate, etc.). The radome 108 and baseplate 112 cooperatively defining an interior in which the printed circuit board (PCB) 116 is positioned as shown in FIG. 3.

The radome 108 and baseplate 112 are configured to protect the PCB 116 and electrically-conductive elements (e.g., patch 104, ground plane 120, radiator 124, copper traces, etc.) on the PCB 116 from damage due to environmental conditions such as vibration or shock during use. The radome 108 and baseplate 112 may be formed from a wide range of materials, such as, for example, polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), other dielectric materials, etc. within the scope of the present disclosure.

The baseplate 112 includes a threaded stud feature 128 (broadly, a mounting feature or fixture) for installing the antenna 100 to a ceiling (broadly, a mounting surface). In this example, the baseplate 112 integrally includes the threaded stud feature 128 such that the baseplate 112 and threaded stud feature have a monolithic construction. Alternatively, the threaded stud feature 128 may instead be attached (e.g., adhesively attached, mechanically fastened, etc.) to the baseplate 112.

Figure 6:
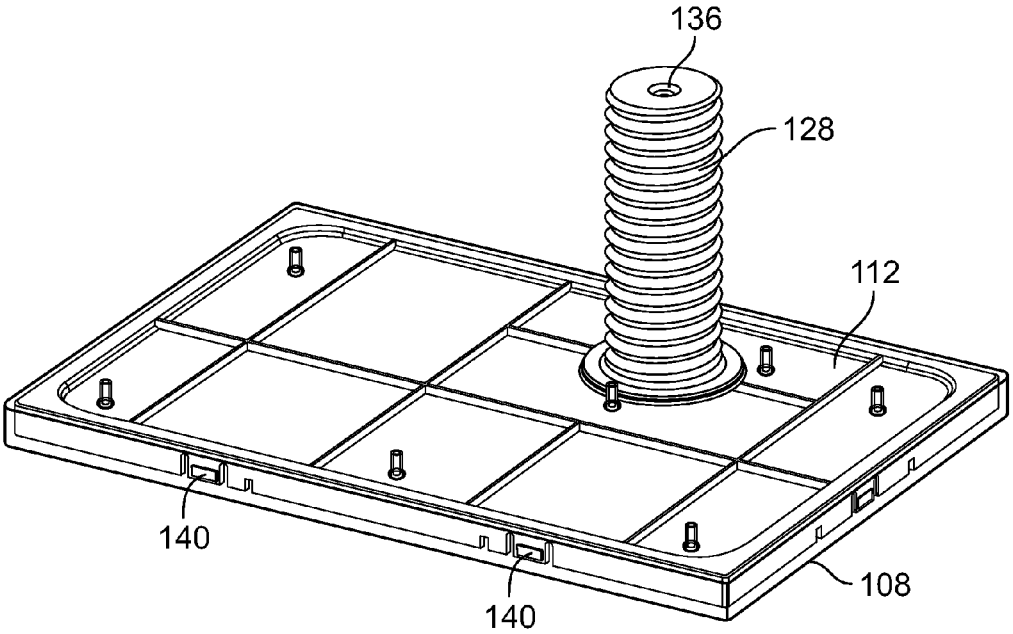
FIG. 6 is a perspective view of the baseplate and radome shown in FIG. 3 after the baseplate is coupled to the radome.

As shown in FIG. 3, the threaded stud feature 128 is generally hollow such that the feed cable 132 (e.g., coaxial cable, other transmission line, etc.) may be fed through the hollow interior of the threaded stud feature 128. As shown in FIG. 6, the threaded stud feature 128 may have a relatively small hole or opening 136 for the cable 132 to inhibit cable movement (e.g., via an interference or friction fit, etc.) and reduce the risk of damage to the cable braid. Also, the feed cable 132 may be a coaxial cable that provides better PIM performance as compared to a fixed connector having less freedom of matching the antenna 100.

Figure 7:
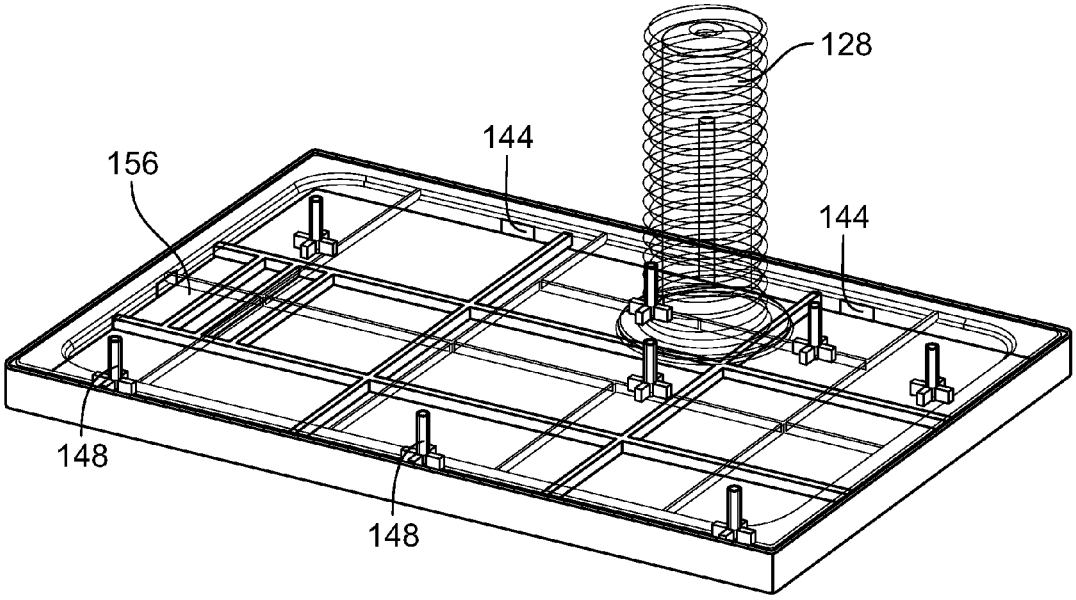
FIG. 7 is a lower perspective view of the radome and baseplate shown in FIG. 6.

The radome 108 and baseplate 112 may be initially or temporarily coupled together by engaging catches 140 of the radome 108 with openings or recesses 144 of the baseplate 112. As shown in FIG. 6, the catches 140 are along the edges of the radome 108, while the recesses 144 are along the edges of the baseplate 112 as shown in FIG. 7.

Figure 5:
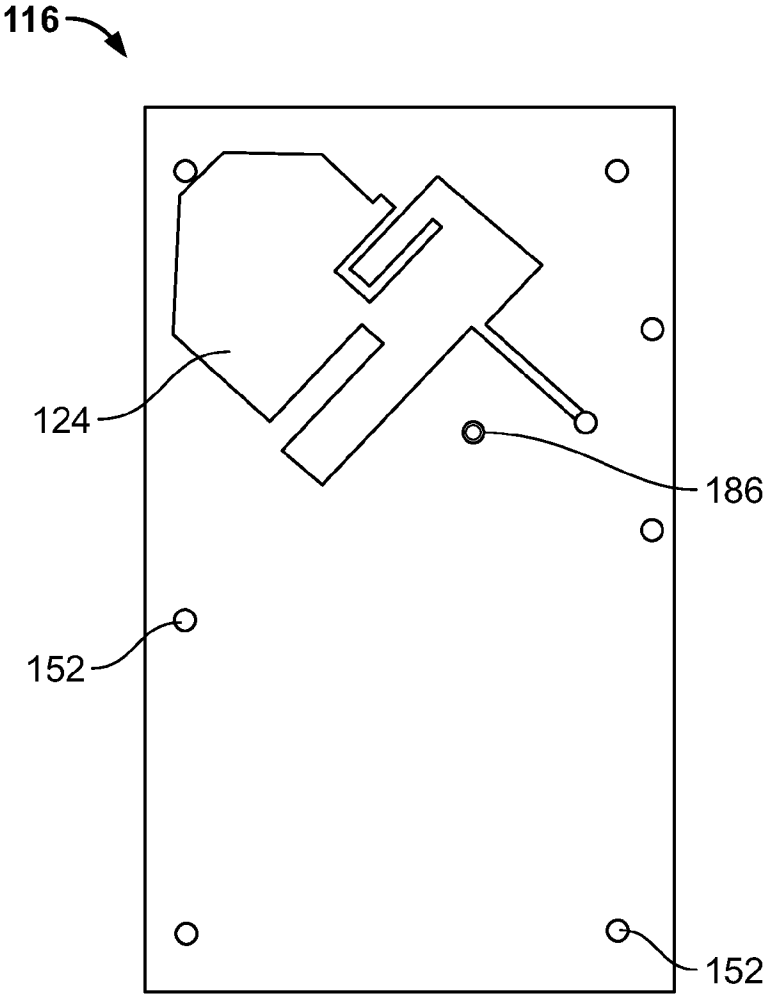
FIG. 5 is a front view of the PCB shown in FIG. 4 and illustrating a radiator along the front side of the PCB.
Figure 4:
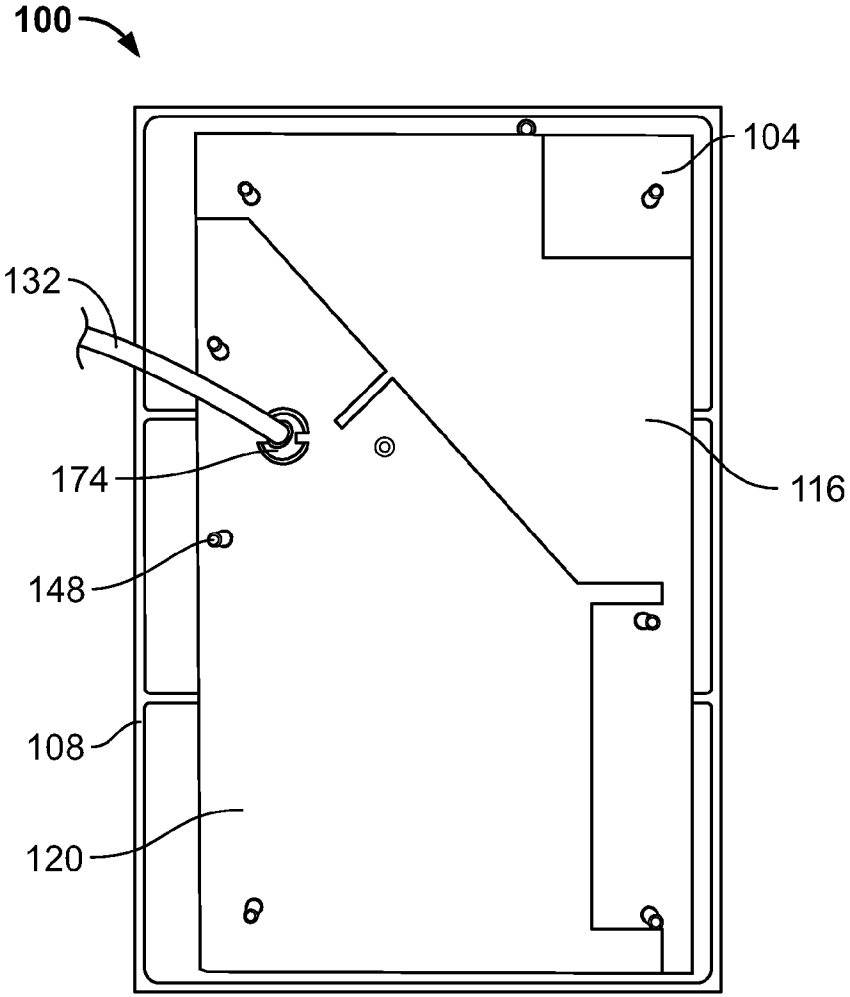
FIG. 4 is a back view of the antenna shown in FIG. 2A without the baseplate and illustrating the ground plane and the patch along the back side of the printed circuit board (PCB) and a feed cable coupled (e.g., soldered, etc.) to the ground plane.

The radome 108 includes heat stakes 148 for final assembly. The heat stakes 148 may be configured (e.g., sized, shaped, located, etc.) to be positioned within corresponding holes or openings 152 in the PCB 116 (FIG. 5). Positioning the heat stakes 148 within the PCB holes 152 (as shown in FIGS. 3 and 4) aligns the PCB 116 and helps retain the positioning of the PCB 116 relative to the baseplate 112 and radome 108. The heat stakes 148 may be configured to allow the antenna 100 to withstand drop and vibration tests without being mechanically fastened together with screws. Also, the engagement of the radome's catches 140 with the baseplate's recesses 144 enable the antenna 100 to be tested before heat staking the radome 108 and baseplate 112 together. Alternatively, the radome 108 and baseplate 112 may be coupled together using other suitable means, such as mechanical fasteners, adhesives, etc.

As shown in FIGS. 2B, the radome 108 includes at least one rib or protruding portion 156 that extends across a portion of the radome 108 such that the at least one rib 156 and ground plane 120 overlap. In this exemplary embodiment, the radome 108 includes three ribs 156 that are parallel with each other. The ribs 156 provide additional dielectric loading to the antenna 100 to add electrical length to the ground plane 120.

As shown in FIG. 8, the back side of the PCB 116 includes a ground plane 120 and the patch 104. The patch 104 proximity couples to the radiator 124 (FIG. 9) along the opposite front side of the PCB 116. The patch 104 is operable for increasing the electrical length of the radiator 124 for broadbanding the antenna bandwidth by extending or broadening the frequency range downward. For example, the addition of the patch 104 may reduce the bottom of the frequency range from 698 MHz to 600 MHz such that the antenna 100 has a greater bandwidth with acceptable omnidirectional radiation patterns. The patch 104 may also be referred to herein as a suspended loading patch or a proximity patch.

With continued reference to FIG. 8, the ground plane 120 includes a slanted surface 162 configured to reduce null and provide better radiation pattern for azimuth plane. For example, the slanted surface 162 may comprise a linear or straight surface along an upper portion of the ground plane 120 extending between and at an angle relative to two horizontal portions 164, 166 of the ground plane 120. The inventors hereof have recognized that the slant angle and the ratio between the radiator length and the ground plane length (e.g., the length from top to bottom of the ground plane along the left hand side of FIG. 10, etc.) are important for the radiation pattern at azimuth plane. By way of example, the slant angle of the slanted surface 162 relative to horizontal may be from about 132 degrees to about 133 degrees (e.g., 132 degrees, 132.5 degrees, 132.7 degrees, 132.9 degrees, 133 degrees, etc.) in exemplary embodiments.

The ground plane portion 166 extends or increases the size of the ground plane 120. The ground plane 120 also includes another portion 168 that extends or increases the size of the ground plane 120. Accordingly, the ground plane portions 166 and 168 electrically lengthen the ground plane 120.

The ground plane 120 includes a slot 170 for increasing the electrical path of the surface of the ground plane 120 that overlaps the radiator 124 to thereby increase impedance. In this exemplary embodiment, the slot 170 is generally rectangular and extends generally perpendicular to and inwardly from the slanted surface 162. Alternatively, the slot 170 may be configured differently, e.g., with a different shape, at a different location, with a different orientation relative to the slanted surface 162, etc.

The ground plane 120 also includes slots 172 (broadly, openings) along opposite sides of the feeding ground point 174 (FIGS. 4 and 8). As shown in FIGS. 4 and 8, the braid of the cable 132 may be soldered to the ground plane exposed solder pad. The slots 172 may be configured to improve bandwidth especially for the high band. In addition, the slots 172 may also be configured to reduce the surface for soldering to reduce the risk of high PIM level. In this exemplary embodiment, the slots 172 are generally rectangular and aligned or parallel with each other. Alternatively, the slots 172 may be configured differently, e.g., with a different shape, at a different location, with a different orientation relative to each other, etc.

Generally, the slots 170, 172 are an absence of electrically-conductive material in the ground plane 120. For example, the ground plane 120 may be initially formed with the slots 170, 172, or the slots 170, 172 may be formed by removing electrically-conductive material from the ground plane 120, such as etching, cutting, stamping, etc. In still yet other embodiments, the slots 170, 172 may be formed by an electrically nonconductive or dielectric material, which is added to the ground plane 120 such as by printing, etc.

As shown in FIG. 9, the front side of the PCB 116 includes the radiator 124. The radiator 124 includes a main or first radiating element 176 configured to be operable to drive the radiator 124 to resonate at low band down to 698 MHz. The radiator 124 further includes two high band (or second and third) radiating elements or arms 178 and 180. The high band radiating element or arm 178 is configured to be operable to drive the resonator 124 to resonate at high band from 1350 MHz to 1710 MHz. The other high band radiating element or arm 180 is configured to be operable to drive the radiator 124 to resonate at high band from 1710 MHz to 3800 MHz and above. The high band radiating elements 178 and/or 180 may have a sufficient length to maintain or improve omnidirectionality, as a shorter length may provide a greater bandwidth at the expense of the radiation pattern. The inventors hereof have also recognized that the gap 181, 183 between the bottom radiator arms or portions of the radiator 124 to the ground plane 120 are important for high band matching.

FIG. 9 also shows a microstrip line 182 extending between the radiator 124 and a feed point 184 for center core soldering of the cable 132. The width of the microstrip line 182 may be used to match the impedance of the antenna 100. Therefore, the microstrip line 182 is not necessarily designed with characteristic impedance at 50 Ohms.

As shown in FIG. 4, the feed cable 132 is electrically coupled (e.g., soldered, etc.) to the feeding ground point 174 along the back side of the PCB 116. The feed cable 132 is also electrically coupled to the radiator 124 on the opposite front side of the PCB 116. In this exemplary embodiment, the PCB 116 includes a hole 186 (FIG. 5) through which the center core of the feed cable 132 is electrically coupled to the feed point 184 (FIG. 8). The feed point 184 is electrically coupled to the microstrip electrical transmission line 182, which, in turn, is electrically coupled to the radiator 124.

In this exemplary embodiment, the patch 104, the ground plane 120, the radiator 124, and the microstrip line 182 comprise electrically-conductive traces (e.g., copper, etc.) along the PCB 116. Alternatively, the patch 104, ground plane 120, radiator 124, and/or microstrip line 182 may comprise other electrically-conductive elements besides copper traces on a PCB, e.g., elements fabricated via stamping parts, plastic plating methods, constructed from sheet metal by cutting, stamping, etching, etc.

The PCB 116 may include a circuit board substrate made of flame retardant 4 (FR4) glass-reinforced epoxy laminate, etc. Additionally, or alternatively, the antenna 100 may include a flexible or rigid substrate, a plastic carrier, an insulator, a flexible circuit board, a flex-film, etc.

FIGS. 10, 11, and 12 provide exemplary dimensions (in millimeters) for the PCB 116. As shown, the PCB 116 may have a height of about 170 mm, a width of about 100 mm, and a thickness of about 0.83 mm. The dimensions in this paragraph (and elsewhere in this application and the drawings) are provided for purposes of illustration only according to exemplary embodiments as alternative embodiments may be configured differently, e.g., smaller or larger, etc.

FIG. 13 illustrates another PCB 216 that may be used with the antenna 100 shown in FIGS. 1 through 3 according to another exemplary embodiment. The PCB 216 may be similar or substantially identical to the PCB 116 described above and shown in FIGS. 8 and 9. For example, the PCB 216 also includes a radiator 224 and a ground plane 220 along opposite front and back sides of the PCB 216. In this exemplary embodiment, however, the PCB 216 does not include a patch 104 along the back side of the PCB 216. Also, the radiator 224 includes a main or first radiating element 276 with a different shape than the corresponding main or first radiating element 176 of the radiator 124.

As shown in FIG. 13, the ground plane 220 includes a slanted surface 262, horizontal portion 264, and slots 270, 272 similar in construction and operation as the corresponding slanted surface 162, horizontal portion 164, and slots 170, 172 of the ground plane 120.

For example, the slanted surface 262 may be configured to reduce null and provide better radiation pattern for azimuth plane. By way of example, the slant angle of the slanted surface 262 relative to horizontal may be from about 132 degrees to about 133 degrees (e.g., 132 degrees, 132.5 degrees, 132.7 degrees, 132.9 degrees, 133 degrees, etc.) in exemplary embodiments.

The horizontal portion 264 extends or increases the size of and electrically lengthens the ground plane 220. The slot 270 may increase the electrical path of the surface of the ground plane 220 that overlaps the radiator 224 to thereby increase impedance. The slots 272 (broadly, openings) along opposite sides of the feeding ground point may improve bandwidth especially for the high band and reduce the surface for soldering to reduce the risk of high PIM level.

The radiator 224 includes a main or first radiating element 276 and two high band (or second and third) radiating elements or arms 278 and 280. The main radiating element 276 may be configured to be operable to drive the radiator 224 to resonate at low band, e.g., down to about 698 MHz, etc. The high band radiating element or arm 278 may be configured to be operable to drive the radiator 224 to resonate at a first high band, e.g., from about 1350 MHz to about 1525 MHz, etc. The other high band radiating element or arm 280 may be configured to be operable to drive the radiator 224 to resonate at second high higher than the first high band, e.g., from about 1690 MHz to about 3800 MHz, etc.

FIG. 13 also shows a microstrip electrical transmission line 282. The microstrip line 282 extends between the radiator 224 and a feed point 284. The feed point 284 may be configured for center core soldering of the cable 232.

The antenna 100 may have an ultra-low profile design (e.g., a radome height or thickness of about 7.6 mm or less, etc.). For example, the dimensions of the radome 108 may be 180.3 mm×117.2 mm×7.6 mm. The antenna 100 may be used as an in-building ceiling mounted cellular network antenna. The antenna 100 may be configured to be aesthetic looking, unobtrusive, and/or have an outer appearance for blending with or matching the color of the ceiling or other mounting surface for the antenna 100. For example, the radome 108 of the antenna 100 may be white or other color to match or blend with the color of the ceiling (e.g., drop ceiling tiles or panels, etc.) to which the antenna 100 may be mounted. Also, the radome 108 may be relatively flat so that the radome 108 will be flush against the ceiling, unobtrusive, and not protrude significantly outwardly from the ceiling after the antenna 100 is mounted to the ceiling. The dimensions in this paragraph (and elsewhere in this application and the drawings) are provided for purposes of illustration only according to exemplary embodiments as alternative embodiments may be configured differently, e.g., smaller or larger, etc.

FIGS. 15B through 81 provide results measured for a prototype of the antenna 100 as shown in FIGS. 1 through 3 with the PCB 116 as shown in FIGS. 10 through 12 that includes the patch 104. FIG. 15A and FIGS. 84 through 137 provide results measured for a prototype of the antenna 100 as shown in FIGS. 1 through 3 with the PCB 216 as shown in FIGS. 14A and 14B that did not include the patch 104. These analysis results are provided only for purposes of illustration and not for purposes of limitation as other exemplary embodiments may be configured differently and/or have different performance.

More specifically, FIG. 15A is an exemplary line graph of voltage standing wave ratio (VSWR) versus frequency in megahertz (MHz) measured for the prototype of the antenna 100 as shown in FIGS. 1 through 3 with the PCB 216 as shown in FIGS. 14A and 14B that did not include the patch 104. Generally, FIG. 15A shows that the prototype antenna without the patch is operable with good voltage standing wave ratio (VSWR) of less than 1.8:1 for frequencies within a first frequency range from about 698 MHz to about 960 and for frequencies within a second frequency range from about 1690 MHz to about 3800 MHz.

FIG. 15B is an exemplary line graph of voltage standing wave ratio (VSWR) versus frequency in megahertz (MHz) measured for the prototype of the antenna 100 as shown in FIGS. 1 through 3 with the PCB 116 as shown in FIGS. 10 through 12 that includes the patch 104. Generally, FIG. 15B shows that the prototype antenna with the patch is operable with good voltage standing wave ratio (VSWR) of less than 1.8:1 for frequencies within a wideband frequency range from about 600 MHz to about 3800 MHz. A comparison of FIGS. 15A and 15B also shows that the addition of the patch 104 can extend the frequency down to 600 MHz.

FIGS. 16 through 81 illustrate radiation patterns (azimuth plane, Phi 0° plane, and Phi 90° plane) measured for the prototype of the antenna 100 as shown in FIGS. 1 through 3 with the PCB 216 as shown in FIGS. 14A and 14B that did not include the patch 104 at frequencies of 698 MHz, 746 MHz, 824 MHz, 894 MHz, 850 MHz, 960 MHz, 1350 MHz, 1448 MHz, 1427 MH, 1525 MHz, 1710 MHz, 1850 MHz, 1930 MHz, 2130 MHz, 2170 MHz, 2310 MHz, 2412 MHz, 2506.5 MHz, 2600 MHz, 2700 MHz, 3300 MHz, and 3800 MHz, respectively. Generally, FIGS. 16 through 81 show the reasonable omnidirectional radiation patterns and good efficiency of the prototype antenna without the patch at these various frequencies that fall within a first frequency range from about 698 MHz to about 960 MHz, a second frequency range from about 1350 MHz to about 1525 MHz, and a third frequency range from about 1710 MHz to 3800 MHz.

FIGS. 82 and 83 are exemplary line graphs of passive intermodulation level (PIM) in decibels relative to carrier (dBc) versus frequency in megahertz (MHz) measured for the prototype of the antenna 100 as shown in FIGS. 1 through 3 with the PCB 216 as shown in FIGS. 14A and 14B that did not include the patch 104. FIGS. 82 and 83 show PIM (IM3) performance for two transmitted carriers (20W each) at respective transmission (Tx) frequencies of 728 MHz to 757 MHz and at 1930 MHz to 1990 MHz. As shown, the prototype antenna without the patch has good low PIM performance (e.g., better or less than −150 dBc, etc.) with a low band peak of −158.9 dBc at 776 MHz and with a high band peak of −153.5 at 1899 MHz.

FIGS. 84 through 137 illustrate radiation patterns (azimuth plane, Phi 0° plane, and Phi 90° plane) measured for the prototype of the antenna 100 as shown in FIGS. 1 through 3 with the PCB 116 as shown in FIGS. 10 through 12 that includes the patch 104 at frequencies of 600 MHz, 645 MHz, 698 MHz, 824 MHz, 850 MHz, 960 MHz, 1350 MHz, 1500 MHz, 1525 MHz, 1680 MHz, 1850 MHz, 1990 MHz, 2170 MHz, 2310 MHz, 2510 MHz, 2700 MHz, 3300 MHz, and 3800 MHz, respectively. Generally, FIGS. 84 through 137 show the reasonable omnidirectional radiation patterns and good efficiency of the prototype antenna with the patch at these various frequencies that fall within a wideband frequency range from about 600 MHz to about 3800 MHz.

FIGS. 138 and 139 are exemplary line graphs of passive intermodulation level (PIM) in decibels relative to carrier (dBc) versus frequency in megahertz (MHz) measured for the prototype of the antenna 100 as shown in FIGS. 1 through 3 with the PCB 116 as shown in FIGS. 10 through 12 that includes the patch 104. FIGS. 138 and 139 show PIM (IM3) performance for two transmitted carriers (20W each) at respective transmission (Tx) frequencies of 728 MHz to 757 MHz and at 1930 MHz to 1990 MHz. As shown, the prototype antenna with the patch has good low PIM performance (e.g., better or less than −150 dBc, etc.) with a low band peak of −160.7 dBc at 776 MHz and a high band peak of −156.5 at 1901 MHz.

FIG. 140 illustrates another exemplary embodiment of an omnidirectional SISO antenna 300 embodying one or more aspects of the present disclosure. As shown, the antenna 300 includes a radiator 324 along a PCB 316 and an electrically-conductive (e.g., aluminum, etc.) tape or foil 320 (broadly, a ground plane). The electrically-conductive tape or foil 320 (e.g., aluminum foil, etc.) defines at least part of the ground plane of the antenna 300.

In this exemplary embodiment, the electrically-conductive tape or foil 320 is coupled to a ground of the radiator 324 via proximity coupling and electrically insulated by the masking of the PCB 316 itself. As shown in FIG. 140, a portion 388 of the electrically-conductive tape 320 is disposed over and overlaps a portion 322 of the PCB 316. The portion 322 of the PCB 316 that overlaps the electrically-conductive tape or foil 320 includes at least a portion of the ground (e.g., copper trace, etc.) for the radiator 324. The overlapping of the portion 388 of the electrically-conductive tape 320 with the portion 322 of the PCB 316 provides proximity coupling between the electrically-conductive tape or foil 320 and the ground 322 of the radiator 324.

The radiator 324 may be similar or identical to the radiator 124 shown in FIGS. 5 and 9. Accordingly, the radiator 324 may also include a main or first radiating element 376 and two high band radiating elements or arms 378 and 380. Alternatively, the radiator 324 may have a different configuration, e.g., similar or identical to the radiator 224 shown in FIG. 13, etc.

With continued reference to FIG. 140, the electrically-conductive tape or foil 320 includes a slanted surface 362 and horizontal portions or stubs 364, 368 that may be similar in construction and operation as the corresponding slanted surface 162 and horizontal portions 164, 168 of the ground plane 120. For example, the horizontal portions 364, 368 extend or increase the size of and electrically lengthen the electrically-conductive tape or foil 320. The slanted surface 362 may be configured to reduce null and provide better radiation pattern for azimuth plane.

The portion 322 of the PCB 316 that overlaps the electrically-conductive tape or foil 320 includes slots 370 and 372. The slots 370 and 372 may be similar in construction and operation as the slots 170 and 172 of the ground plane 120.

The PCB 316 does not extend entirely over the electrically-conductive tape or foil 320 such that less PCB material is needed. As shown in FIG. 140, the PCB 316 extends across or overlaps only a portion 388 of the electrically-conductive tape or foil 320. In this exemplary embodiment, the PCB 316 is about half the size of the PCB 116 shown in FIG. 5. By using less of the relatively expensive PCB material (e.g., FR4 glass-reinforced epoxy laminate, etc.), the cost of the antenna can be reduced.

The antenna 300 includes a patch 304 similar or identical to the patch 104 shown in FIGS. 4 and 8 and described above. The patch 304 may comprise an electrically-conductive (e.g., copper, etc.) trace along the back side of the PCB 316. The patch 304 may proximity couple to the radiator 324 along the opposite front side of the PCB 316. The patch 304 may be operable for increasing the electrical length of the radiator 324 for broadbanding the antenna bandwidth by extending or broadening the frequency range downward. In other embodiments, the antenna 300 does not include any patch on the back side of the PCB 316.

FIG. 140 also shows a microstrip electrical transmission line 382. The transmission line 382 extends between the radiator 324 and a feed point 384. The feed point 384 may allow for center core soldering of a coaxial feed cable 390. For example, inner conductor of the coaxial feed cable 390 may be electrically connected (e.g., soldered, etc.) to the radiator 324. The outer cable braid of the coaxial feed cable 390 may be electrically connected (e.g., soldered, etc.) to the portion 322 of the PCB 316 that overlaps the electrically-conductive tape or foil 320 and includes at least a portion of the ground.

The antenna 300 may also include a baseplate and radome similar or identical to the baseplate 112 and radome 108 shown in FIG. 1 and described above.

The antenna 300 may be configured for wideband operation or multiband operation. For example, the antenna 300 may be configured to be operable within a wideband frequency range, such as from about 600 MHz to about 3800 MHz, etc. Or, for example, the antenna 300 may be configured to be operable within multiple frequency ranges, such as a first frequency range from about 698 MHz to about 960 MHz, a second frequency range from about 1350 MHz to about 1525 MHz, and a third frequency range from about 1690 MHz to about 3800 MHz, etc.

The antenna 300 may have an ultra-low profile design (e.g., a radome height or thickness of about 7.6 mm or less, etc.). For example, the dimensions of the radome may be 180.3 mm×117.2 mm×7.6 mm. The antenna 300 may be used as an in-building ceiling mounted cellular network antenna. The antenna 300 may be configured to be aesthetic looking, unobtrusive, and/or have an outer appearance for blending with or matching the color of the ceiling or other mounting surface for the antenna 300. For example, the radome of the antenna 300 may be white or other color to match or blend with the color of the ceiling (e.g., drop ceiling tiles or panels, etc.) to which the antenna 300 may be mounted. Also, the radome may be relatively flat so that the radome will be flush against the ceiling, unobtrusive, and not protrude significantly outwardly from the ceiling after the antenna 300 is mounted to the ceiling. The dimensions in this paragraph (and elsewhere in this application and the drawings) are provided for purposes of illustration only according to exemplary embodiments as alternative embodiments may be configured differently, e.g., smaller or larger, etc.

FIG. 141 provides exemplary dimensions in millimeters and angles in degrees for the electrically-conductive tape or foil 320 shown in FIG. 140, which are provided for purposes of illustration only according to an exemplary embodiment. In this exemplary embodiment shown in FIG. 141, the height is 100 millimeters, and the slant angle of the slanted surface relative to horizontal is 133 degrees. Alternative embodiments may be configured differently, e.g., smaller, larger, differently shaped, etc.

FIG. 142 is an exemplary line graph of voltage standing wave ratio (VSWR) versus frequency in megahertz (MHz) measured for a prototype of the antenna 300 shown in FIG. 140 including the PCB 316, radiator 324, and aluminum tape or foil 320 with dimensions similar to the dimensions disclosed herein. Generally, FIG. 142 shows the achievable bandwidth of an antenna including PCB 316, radiator 324, and aluminum tape or foil 320. FIG. 142 also shows that an antenna with the PCB 316, radiator 324, and aluminum tape or foil 320 is operable with good voltage standing wave ratio (VSWR) of less than 1.8:1 for frequencies within a frequency range from about 608 MHz to about 960 and for frequencies from about 1520 MHz to about 2700 MHz. As shown in FIG. 142, the VSWR was 1.72 at 608 MHz, 1.21 at 698 MHz, 1.1 at 824 MHz, 1.21 at 960 MHz, 1.58 at 1520 MHz, 1.45 at 1710 MHz, 1.11 at 2170 MHz, and 1.16 at 2700 MHz. These VSWR results are provided only for purposes of illustration and not for purposes of limitation as other exemplary embodiments may be configured differently and/or have different performance.

FIGS. 143 and 144 illustrates another exemplary embodiment of an omnidirectional SISO antenna 400 embodying one or more aspects of the present disclosure. As shown in FIG. 143, the antenna 400 includes a dielectric spacer 492 (e.g., plastic washer, etc.) positioned between the baseplate or support member 412 and a back side of the PCB 416. The dielectric spacer 492 is disposed generally around a second opening or hole 494 of the threaded stud feature 428 of the baseplate 412.

The antenna 400 also includes a feed cable 432 (e.g., coaxial cable, other transmission line, etc.) that is fed through a first opening into and through the hollow interior of the threaded stud feature 428 and out the second opening 494 to a feeding ground point. The first opening of the threaded stud feature 428 may be relatively small to inhibit cable movement (e.g., via an interference or friction fit, etc.) and reduce the risk of damage to the cable braid. Also, the feed cable 432 may be a coaxial cable that provides better PIM performance as compared to a fixed connector having less freedom of matching the antenna 400.

FIG. 144 shows the PCB 416 and dielectric spacer 492 positioned within an interior enclosure cooperatively defined between the baseplate 412 and a radome 408. Without the dielectric 492, the area indicated by ovals 496 adjacent the hole 494 of the threaded stud feature 428 may be subject to deformation or flexing during a pull test. The pull test is indicated by the downward arrow in FIG. 144.

The dielectric spacer 492 is configured to help reduce or eliminate deformation or flexing of the PCB 416 adjacent or around the hole 494 that might otherwise occur due to the softness or flexibility of the substrate material (e.g., type and/or thickness, etc.) of PCB 416. Deformation or flexing of the PCB 416 might elevate the PIM level and change the VSWR of the antenna 400. The dielectric spacer 492 helps make the area 496 adjacent the relatively large stud hole 494 firmer and less susceptible to deformation or flexing without damaging the PCB and elevating the PIM level. Accordingly, the dielectric spacer 492 may thus help make the PCB firmer, reduce the deformation or flexing caused by the pull test, and help maintain an acceptable PIM level and VSWR of the antenna 400.

The PCB 416 may be similar or substantially identical to a PCB disclosed herein, such as the PCB 116 shown in FIGS. 8 and 9, PCB shown in FIGS. 10 through 12, PCB 216 shown in FIG. 13, PCB shown in FIGS. 14A and 14B, PCB 316 shown in FIG. 140, PCB shown in FIG. 140, etc. The baseplate 412 and radome 408 may be similar or substantially identical to a baseplate and radome disclosed herein, such as the baseplate 112 and radome 108 shown in FIGS. 1 through 4, 6, and 7, etc. The radome 408 may be similar or substantially identical to a radome disclosed herein, such as the radome 108 shown in FIGS. 1 through 4. Any one of more of the antennas disclosed herein (e.g., antenna 100 (FIGS. 1 through 4), antenna 300 (FIG. 140), etc.) may also include a dielectric spacer 492 as shown in FIGS. 143 and 144.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna comprising:

a radiator; and a ground plane that is asymmetrical and including a slanted surface along or defining an edge portion of the ground plane, whereby the slanted surface is operable for reducing null at azimuth plane to thereby allow the antenna to have more omnidirectional radiation patterns for the azimuth plane; wherein the ground plane includes:

a slot extending inwardly from the edge portion of the ground plane defined by the slanted surface, the slot operable for increasing an electrical path of a surface of the ground plane that overlaps the radiator to thereby increase impedance for impedance matching; and at least one slot adjacent to a feeding ground point that reduces a surface for soldering to thereby reduce a risk of high passive intermodulation level.

2. The antenna of claim 1, further comprising a substrate having opposite front and back sides, and wherein:

the radiator is along the front side of the substrate;

the ground plane is along the back side of the substrate; and the substrate is between the radiator and the ground plane.

3. The antenna of claim 2, further comprising a patch along the back side of the substrate spaced apart from the ground plane, whereby the patch proximity couples to the radiator along the front side of the substrate for increasing an electrical length of the radiator and thereby broaden antenna bandwidth by extending frequency range downward.

4. The antenna of claim 2, wherein:

the antenna comprises a horizontal planar asymmetrical dipole antenna having first and second asymmetrical arms along the respective front and back sides of the substrate;

the first asymmetrical arm defines or includes the radiator; and the second asymmetrical arm defines or includes the ground plane.

5. The antenna of claim 2, wherein:

a microstrip electrical transmission line along the front side of the substrate extends between the radiator and a feed point;

the substrate comprises a printed circuit board;

the radiator comprises an electrically-conductive trace along the front side of the printed circuit board; and the ground plane comprises an electrically-conductive tape or foil and/or an electrically-conductive trace along the back side of the printed circuit board.

6. The antenna of claim 1, wherein:

the slot extending inwardly from the edge portion of the ground plane defined by the slanted surface includes a rectangular slot extending generally perpendicular to and inwardly from the edge portion of the ground plane defined by the slanted surface; and the at least one slot adjacent to the feeding point includes a pair of rectangular slots along opposite sides of a feeding ground point.

7. The antenna of claim 1, wherein the ground plane includes:

a first portion adjacent to an end portion of the slanted surface and extending outwardly relative to the ground plane to electrically lengthen the ground plane; and a second portion spaced apart from the slanted surface and extending outwardly relative to the ground plane to electrically lengthen the ground plane.

8. The antenna of claim 1, wherein:

the antenna is a single-input single-output (SISO) in-building ceiling mountable cellular network antenna; and the radiator includes:

a first radiating element operable to drive the radiator to resonate at low band;

a second radiating element operable to drive the radiator to resonate at a first high band; and a third radiating element operable to drive the radiator to resonate at a second high band higher than the first high band.

9. The antenna of claim 1, further comprising:

a baseplate including a mounting feature for mounting the antenna to a mounting surface;

a radome coupled to the baseplate;

wherein the radiator and the ground plane are positioned within an interior cooperatively defined between the radome and the baseplate; and wherein the mounting feature includes a hollow interior to allow a coaxial feed cable to be fed through the hollow interior to a feeding ground point; and wherein:

the radome includes at least one rib or protruding portion at a predetermined location along the radome that provides additional dielectric loading to the antenna to thereby add electrical length to the ground plane; and/or the mounting feature includes a first opening into the hollow interior of the mounting feature for the coaxial feed cable that is sized to inhibit cable movement thereby reducing risk of damage to a cable braid of the coaxial feed cable; and/or the antenna further comprises a substrate having opposite front and back sides along which the radiator and the ground plane are respectively positioned, and a dielectric spacer between the baseplate and the back side of the substrate, whereby the dielectric spacer is disposed generally around a second opening of the mounting feature and operable to help reduce deformation or flexing of the substrate adjacent the second opening.

10. The antenna of claim 1, wherein:

the antenna is operable within a frequency range from about 600 MHz to about 3800 MHz, and the antenna is omnidirectional in the azimuth plane at frequencies within the frequency range from about 600 MHz to about 3800 MHz; or the antenna is operable within a first frequency range from about 698 MHz to about 960 MHz, a second frequency range from about 1350 MHz to about 1525 MHz, and a third frequency range from about 1690 MHz to about 3800 MHz, and the antenna is omnidirectional in the azimuth plane at frequencies within the first, second, and third frequencies.

11. The antenna of claim 1, further comprising an electrically-conductive tape or foil defining at least part of the ground plane.

12. The antenna of claim 11, wherein:

the antenna further comprises a substrate having opposite front and back sides;

the radiator is along the front side of the substrate;

a portion of a ground of the radiator along a back side of the substrate overlaps a portion of the electrically-conductive tape or foil to thereby provide proximity coupling between the electrically-conductive tape or foil and the ground of the radiator; and the substrate is between the radiator along the front side of the substrate and the portion of the ground of the radiator along the back side of the substrate.

13. The antenna of claim 12, wherein:

the substrate covers only a portion of the electrically-conductive tape or foil; and the electrically-conductive tape or foil does not include any slots; and the electrically-conductive tape or foil includes at least one portion extending outwardly relative to the ground plane defined by the electrically-conductive tape or foil to thereby electrically lengthen the ground plane.

14. An antenna comprising:

a substrate;

a radiator along the substrate; and an electrically-conductive tape or foil defining at least part of a ground plane that is asymmetrical, the electrically-conductive tape or foil coupled to a ground of the radiator via proximity coupling and electrically insulated by masking of the substrate; and wherein the ground of the radiator includes:

a slot extending inwardly from an edge portion of the ground of the radiator, the slot operable for increasing an electrical path of a surface of the ground of the radiator to thereby increase impedance for impedance matching; and at least one slot adjacent to a feeding ground point that reduces a surface for soldering to thereby reduce a risk of high passive intermodulation level.

15. The antenna of claim 14, wherein the electrically-conductive tape or foil includes a slanted surface along or defining an edge portion of the ground plane, whereby the slanted surface is operable for reducing null at azimuth plane to thereby allow the antenna to have more omnidirectional radiation patterns for the azimuth plane.

16. The antenna of claim 14, wherein:

the substrate includes opposite front and back sides spaced apart by a thickness of the substrate;

the radiator is along the front side of the substrate;

a portion of a ground of the radiator along a back side of the substrate overlaps a portion of the electrically-conductive tape or foil to thereby provide proximity coupling between the electrically-conductive tape or foil and the ground of the radiator; and the antenna further comprises a patch along the back side of the substrate spaced apart from the ground plane, whereby the patch proximity couples to the radiator along the front side of the substrate for increasing an electrical length of the radiator and thereby broaden antenna bandwidth by extending frequency range downward.

17. The antenna of claim 14, wherein:

the substrate covers only a portion of the electrically-conductive tape or foil; and the electrically-conductive tape or foil includes at least one portion extending outwardly relative to the ground plane defined by the electrically-conductive tape or foil to thereby electrically lengthen the ground plane; and wherein the radiator includes:

a first radiating element operable to drive the radiator to resonate at low band;

a second radiating element operable to drive the radiator to resonate at a first high band; and a third radiating element operable to drive the radiator to resonate at a second high band higher than the first high band.

18. The antenna of claim 14, further comprising:

a baseplate including a mounting feature for mounting the antenna to a mounting surface;

a radome coupled to the baseplate;

wherein the substrate, the radiator, and the electrically-conductive tape or foil are positioned within an interior cooperatively defined between the radome and the baseplate; and wherein the mounting feature includes a hollow interior to allow a coaxial feed cable to be fed through the hollow interior to a feeding ground point; and wherein:

the radome includes at least one rib or protruding portion at a predetermined location along the radome that provides additional dielectric loading to the antenna to thereby add electrical length to the ground plane; and/or the mounting feature includes a first opening for the coaxial feed cable that is sized to inhibit cable movement thereby reducing risk of damage to a cable braid of the coaxial feed cable; and/or the antenna further comprises a dielectric spacer between the baseplate and the substrate, whereby the dielectric spacer is disposed generally around a second opening of the mounting feature and configured to help reduce deformation or flexing of the substrate adjacent to the second opening.

19. The antenna of claim 14:

wherein the antenna is a single-input single-output (SISO) in-building ceiling mountable cellular network antenna; and wherein:

the antenna is operable within a frequency range from about 600 MHz to about 3800 MHz, and the antenna is omnidirectional in the azimuth plane at frequencies within the frequency range from about 600 MHz to about 3800 MHz; or the antenna is operable within a first frequency range from about 698 MHz to about 960 MHz, a second frequency range from about 1350 MHz to about 1525 MHz, and a third frequency range from about 1690 MHz to about 3800 MHz, and the antenna is omnidirectional in the azimuth plane at frequencies within the first, second, and third frequencies.

* * * * *